US008303730B2

(12) United States Patent
Kumano et al.

(10) Patent No.: US 8,303,730 B2
(45) Date of Patent: Nov. 6, 2012

(54) MANUFACTURING METHOD OF GRAIN-ORIENTED ELECTRICAL STEEL SHEET

(75) Inventors: Tomoji Kumano, Tokyo (JP); Yoshiyuki Ushigami, Tokyo (JP); Shuichi Nakamura, Tokyo (JP); Yohichi Zaizen, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/060,647

(22) PCT Filed: Sep. 8, 2009

(86) PCT No.: PCT/JP2009/065682

§ 371 (c)(1),
(2), (4) Date: Feb. 24, 2011

(87) PCT Pub. No.: WO2010/029921

PCT Pub. Date: Mar. 18, 2010

(65) Prior Publication Data

US 2011/0155285 A1 Jun. 30, 2011

(30) Foreign Application Priority Data

Sep. 10, 2008 (JP) ..... 2008-232569

(51) Int. Cl.
*H01F 1/147* (2006.01)

(52) U.S. Cl. ..... 148/111; 148/308

(58) Field of Classification Search ..... None
See application file for complete search history.

(56) References Cited

U.S. PATENT DOCUMENTS

| | | | |
|---|---|---|---|
| 3,933,024 | A | 1/1976 | Matsumoto et al. |
| 4,623,406 | A | 11/1986 | Suga et al. |
| 4,623,407 | A | 11/1986 | Suga et al. |
| 4,753,692 | A | 6/1988 | Kuroki et al. |
| 4,806,176 | A | 2/1989 | Harase et al. |
| 4,863,532 | A | 9/1989 | Kuroki et al. |
| 4,898,626 | A | 2/1990 | Shoen et al. |
| 4,979,996 | A | 12/1990 | Kobayashi et al. |

(Continued)

FOREIGN PATENT DOCUMENTS

EP 0947597 B1 1/2005

(Continued)

OTHER PUBLICATIONS

Kumano et al., "Influence of Primary Recrystallization Texture Through Thickness to Secondary Texture on Grain Oriented Silicon Steel", ISIJ International, vol. 43, No. 3, 2003, pp. 400-409.

(Continued)

*Primary Examiner* — John Sheehan
(74) *Attorney, Agent, or Firm* — Birch, Stewart, Kolasch & Birch, LLC

(57) ABSTRACT

A slab with a predetermined composition is heated at 1280° C. to 1390° C. to make a substance functioning as an inhibitor to be solid-solved (step S1). Next, the slab is hot-rolled to obtain a steel strip (step S2). The steel strip is annealed to form a primary inhibitor in the steel strip (step S3). Next, the steel strip is cold-rolled once or more (step S4). Next, the steel strip is annealed to perform decarburization and to cause primary recrystallization (step S5). Next, nitriding treatment is performed on the steel strip in a mixed gas of hydrogen, nitrogen and ammonia under a state where the steel strip runs, to form a secondary inhibitor in the steel strip (step S6). Next, the steel strip is annealed to induce secondary recrystallization (step S7).

9 Claims, 5 Drawing Sheets

U.S. PATENT DOCUMENTS

| | | | | |
|---|---|---|---|---|
| 5,215,603 | A | 6/1993 | Nakayama et al. | |
| 5,643,370 | A | 7/1997 | Huppi | |
| 5,759,293 | A | 6/1998 | Takahashi et al. | |
| 5,779,819 | A | 7/1998 | Huppi | |
| 6,432,222 | B2 | 8/2002 | Ohata et al. | |
| 6,451,128 | B1 * | 9/2002 | Lee et al. | 148/111 |
| 7,833,360 | B2 | 11/2010 | Kumano et al. | |
| 7,857,915 | B2 | 12/2010 | Kumano et al. | |
| 8,097,094 | B2 * | 1/2012 | Murakami | 148/307 |
| 2002/0007870 | A1 | 1/2002 | Ohata et al. | |
| 2002/0011278 | A1 * | 1/2002 | Komatsubara et al. | 148/120 |
| 2007/0062611 | A1 * | 3/2007 | Murakami | 148/111 |
| 2009/0032142 | A1 | 2/2009 | Kumano et al. | |
| 2009/0044881 | A1 | 2/2009 | Kumano et al. | |

FOREIGN PATENT DOCUMENTS

| | | | |
|---|---|---|---|
| JP | 40-15644 | | 7/1965 |
| JP | 50-16610 | A | 2/1975 |
| JP | 57-198214 | A | 12/1982 |
| JP | 58-23414 | A | 2/1983 |
| JP | 59-56522 | A | 4/1984 |
| JP | 60-218426 | A | 1/1985 |
| JP | 60-177131 | A | 9/1985 |
| JP | 1-290716 | A | 11/1989 |
| JP | 2-182866 | A | 7/1990 |
| JP | 5-112827 | A | 5/1993 |
| JP | 7-252532 | A | 10/1995 |
| JP | 7-305116 | A | 11/1995 |
| JP | 8-253815 | A | 1/1996 |
| JP | 8-279408 | A | 10/1996 |
| JP | 9-118964 | A | 5/1997 |
| JP | 11-21627 | A | 1/1999 |
| JP | 2000-199015 | A | 7/2000 |
| JP | 2001-152250 | A | 6/2001 |
| JP | 2005-226111 | A | 8/2005 |
| JP | 2007-238984 | A | 9/2007 |
| WO | WO 2006/132095 | A1 | 12/2006 |

OTHER PUBLICATIONS

Morito et al., "History and Recent Development of Grain Oriented Electrical Steel at Kawasaki Steel", Kawasaki Steel Giho (Technical Report), vol. 29, No. 3, 1997, pp. 129-135.

Yoshitomi et al., "Coincidence Grain Boundary and Role of Primary Recrystallized Grain Growth on Secondary Recrystallization Texture Evolution in Fe-3%Si Alloy", Acta Metall., vol. 42, No. 8, 1994, pp. 2593-2602, Elsevier Science Ltd.

* cited by examiner

MANUFACTURING METHOD OF GRAIN-ORIENTED ELECTRICAL STEEL SHEET

TECHNICAL FIELD

The present invention relates to a manufacturing method of a grain-oriented electrical steel sheet suitable for an iron core of a transformer and the like.

BACKGROUND ART

Conventionally, secondary recrystallization has been utilized for manufacturing a grain-oriented electrical steel sheet. When the secondary recrystallization is utilized, it is important to control a texture, an inhibitor (grain growth inhibitor) and a grain structure. AlN has been mainly used as an inhibitor of a high magnetic flux density grain-oriented electrical steel sheet, and various studies have been conducted on the control thereof.

However, it is not easy to cause the secondary recrystallization stable, and it is difficult to obtain sufficient magnetic property through the conventional method.

CITATION LIST

PATENT LITERATURE

Patent Document 1: Japanese Examined Patent Application Publication No. 40-15644

Patent Document 2: Japanese Laid-open Patent Publication No. 58-023414

Patent Document 3: Japanese Laid-open Patent Publication No. 05-112827

Patent Document 4: Japanese Laid-open Patent Publication No. 59-056522

Patent Document 5: Japanese Laid-open Patent Publication No. 09-118964

Patent Document 6: Japanese Laid-open Patent Publication No. 02-182866

Patent Document 7: Japanese Laid-open Patent Publication No. 2000-199015

Patent Document 8: Japanese Laid-open Patent Publication No. 2001-152250

Patent Document 9: Japanese Laid-open Patent Publication No. 60-177131

Patent Document 10: Japanese Laid-open Patent Publication No. 07-305116

Patent Document 11: Japanese Laid-open Patent Publication No. 08-253815

Patent Document 12: Japanese Laid-open Patent Publication No. 08-279408

Patent Document 13: Japanese Laid-open Patent Publication No. 57-198214

Patent Document 14: Japanese Laid-open Patent Publication No. 60-218426

Patent Document 15: Japanese Laid-open Patent Publication No. 50-016610

Patent Document 16: Japanese Laid-open Patent Publication No. 07-252532

Patent Document 17: Japanese Laid-open Patent Publication No. 01-290716

Patent Document 18: Japanese Laid-open Patent Publication No. 2005-226111

Patent Document 19: Japanese Laid-open Patent Publication No. 2007-238984

Patent Document 20: International Publication pamphlet No. WO 06/132095

NON-PATENT LITERATURE

Non-Patent Document 1: ISIJ International, Vol. 43 (2003), No. 3, pp. 400 to 409

Non-Patent Document 2: Acta Metall., 42 (1994), 2593

Non-Patent Document 3: Kawasaki Steel Giho Vol. (1997) 3, 129 to 135

SUMMARY OF THE INVENTION

Technical Problem

The present invention has an object to provide a manufacturing method of a grain-oriented electrical steel sheet capable of stably obtaining good magnetic properties.

Solution to Problem

A manufacturing method of a grain-oriented electrical steel sheet according to the present invention, includes: heating a slab containing: C: 0.04 mass % to 0.09 mass %; Si: 2.5 mass % to 4.0 mass %; acid-soluble Al: 0.022 mass % to 0.031 mass %; N: 0.003 mass % to 0.006 mass %; S and Se: 0.013 mass % to 0.022 mass % when converted into an S equivalent Seq represented by "[S]+0.405×[Se]" in which an S content is set as [S] and a Se content is set as [Se]; Mn: 0.045 mass % to 0.065 mass %; a Ti content being 0.005 mass % or less; and a balance being composed of Fe and inevitable impurities at 1280° C. to 1390° C., to make a substance functioning as an inhibitor to be solid-solved; next, hot-rolling the slab to obtain a steel strip; annealing the steel strip to form a primary inhibitor in the steel strip; next, cold-rolling the steel strip once or more; next, annealing the steel strip to perform decarburization and to cause primary recrystallization; next, performing nitriding treatment on the steel strip in a mixed gas of hydrogen, nitrogen and ammonia under a state where the steel strip is running to form a secondary inhibitor in the steel strip; and next, annealing the steel strip to cause secondary recrystallization. In the hot rolling, a ratio of N, contained in the slab, that is precipitated as AlN in the steel strip is set to 35% or less, and a ratio of S and Se, contained in the slab, that are precipitated as MnS or MnSe in the steel strip is set to 45% or less when converted into the S equivalent. The annealing to form the primary inhibitor in the steel strip is performed before a last-performed one of the cold rolling that is performed once or more. A rolling rate in the last-performed one of the cold rolling that is performed once or more is set to 84% to 92%. A circle-equivalent average grain diameter (diameter) of crystal grains obtained through the primary recrystallization is set to not less than 8 μm nor more than 15 μm. When a Mn content (mass %) in the slab is set as [Mn], a value A represented by an equation (1) satisfies an equation (2). When a N content (mass %) in the slab is set as [N], and an amount of N (mass %) in the steel strip that is increased by the nitriding treatment is set as ΔN, a value I represented by an equation (3) satisfies an equation (4).

[Mathematical expression 1]

$$A=([Mn]/54.9)/(Seq/32.1) \quad \text{equation (1)}$$

$$1.6 \leqq A \leqq 2.3 \quad \text{equation (2)}$$

[Mathematical expression 2]

$$I=1.3636\times[Seq]/32.1+0.5337\times[N]/14.0+0.7131\times\Delta N/14.0 \quad \text{equation (3)}$$

$$0.0011\leqq I\leqq 0.0017 \quad \text{equation (4)}$$

Advantageous Effects of Invention

According to the present invention, a composition of slab is appropriately defined, and further, conditions of hot rolling, cold rolling, annealing and nitriding treatment are also appropriately defined, so that it is possible to appropriately form a primary inhibitor and a secondary inhibitor. As a result of this, a texture obtained through secondary recrystallization is improved, which enables to stably obtain good magnetic properties.

DESCRIPTION OF EMBODIMENTS

A grain growth inhibiting effect provided by an inhibitor depends on an element, a size (form) and an amount of the inhibitor. Therefore, the grain growth inhibiting effect depends also on a method of forming the inhibitor.

Figure 1:
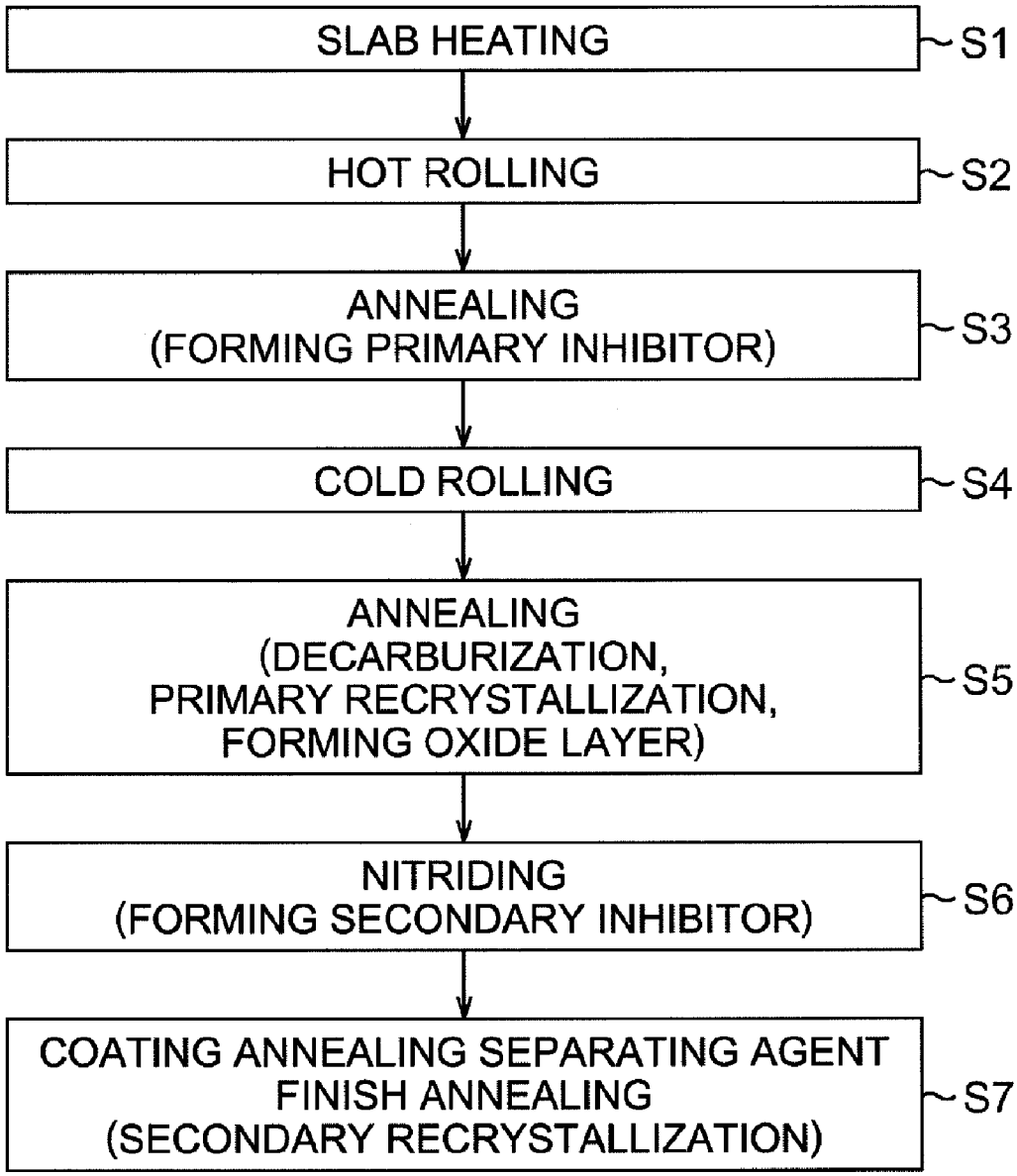
FIG. 1 is a flow chart showing a manufacturing method of a grain-oriented electrical steel sheet according to an embodiment of the present invention.

Accordingly, in an embodiment of the present invention, a grain-oriented electrical steel sheet is manufactured while controlling a formation of inhibitor, in accordance with a flow chart shown in FIG. 1. Here, an outline of the method will be described.

A slab having a predetermined composition is heated (step S1), to make a substance functioning as an inhibitor to be solid-solved.

Next, hot rolling is performed, to thereby obtain a steel strip (hot-rolled steel strip) (step S2). In the hot rolling, fine AlN precipitates are formed.

Thereafter, the steel strip (hot-rolled steel strip) is annealed, in which precipitates such as AlN, MnS, Cu—S and MnSe (primary inhibitors) with proper sizes and amounts are formed (step S3).

Subsequently, the steel strip after annealed in step S3 (first annealed steel strip) is subjected to cold rolling (step S4). The cold rolling may be performed only once, or may also be performed in a plurality of times with an intermediate annealing therebetween. If the intermediate annealing is performed, it is also possible to omit the annealing in step S3 and to form the primary inhibitors in the intermediate annealing.

Next, the steel strip after the cold rolling is performed thereon (cold-rolled steel strip) is annealed (step S5). During the annealing, decarburization is carried out, and further, primary recrystallization is caused and an oxide layer a raw material for a glass film, a primary film or a forsterite film) is formed on a surface of the cold-rolled steel strip.

Thereafter, the steel strip after annealed in step S5 (second annealed steel strip) is subjected to nitriding treatment (step S6). Specifically, nitrogen is introduced into the steel strip. By this nitriding treatment, precipitates of AlN (secondary inhibitors) are formed.

Subsequently, an annealing separating agent is coated on surfaces of the steel strip after the nitriding treatment is performed thereon (nitrided steel strip), and after that, the steel strip is subjected to finish annealing (step S7). During the finish annealing, secondary recrystallization is induced.

(Composition of Slab)

Next, a composition of slab will be described.

C: 0.04 mass % to 0.09 mass %

When a C content is less than 0.04 mass %, it is not possible to achieve an appropriate texture obtained through the primary recrystallization. When the C content exceeds 0.09 mass %, the decarburization treatment (step S5) becomes difficult to be performed for preventing magnetic aging. Therefore, the C content is set to 0.04 mass % to 0.09 mass %.

Si: 2.5 mass % to 4.0 mass %

When a Si content is less than 2.5 mass %, good iron loss cannot be obtained. When the Si content exceeds 4.0 mass %, the cold rolling (step S4) becomes quite difficult to be performed. Therefore, the Si content is set to 2.5 mass % to 4.0 mass %.

Mn: 0.045 mass % to 0.065 mass %

When a Mn content is less than 0.045 mass %, a crack is likely to occur during the hot rolling (step S2), which decreases yield. Further, the secondary recrystallization (step S7) is not stabilized. When the Mn content exceeds 0.065 mass %, amounts of MnS and MnSe in the slab increase, so that there is a need to increase the temperature for heating the slab (step S1) in order to make MnS and MnSe to be appropriately solid-solved, which leads to an increase in cost and the like. Further, when the Mn content exceeds 0.065 mass %, a level at which Mn is solid-solved is likely to be non-uniform depending on positions, at the time of heating the slab (step S1). Therefore, the Mn content is set to 0.045 mass % to 0.065 mass %.

Acid-soluble Al: 0.022 mass % to 0.031 mass %

Acid-soluble Al bonds to N to form AlN. Further, AlN functions as a primary inhibitor and a secondary inhibitor. As described above, the primary inhibitor is formed during the annealing (step S3), and the secondary inhibitor is formed during the nitriding treatment (step S6). When an acid-soluble Al content is less than 0.022 mass %, a formation amount of AlN is insufficient, and further, the sharpness of the Goss orientation ({110}<001>) of crystal grains in a texture obtained through the secondary recrystallization (step S7) is deteriorated. When the acid-soluble Al content exceeds 0.031 mass %, there is a need to increase the temperature at the time of heating the slab (step S1) in order to achieve secure solid-solution of AlN. Therefore, the acid-soluble Al content is set to 0.022 mass % to 0.031 mass %.

N: 0.003 mass % to 0.006 mass %

N is important for forming AlN that functions as an inhibitor. However, when a N content exceeds 0.006 mass %, there is a need to set the temperature for heating the slab (step S1) to be higher than 1390° C. in order to achieve secure solid-solution. Further, the sharpness of the Goss orientation of crystal grains in a texture obtained through the secondary recrystallization (step S7) is deteriorated. When the N content is less than 0.003 mass %, AlN that functions as the primary inhibitor cannot be sufficiently precipitated, resulting in that the control of grain diameters of primary recrystallization grains obtained through the primary recrystallization (step S5) becomes difficult to be conducted. For this reason, the secondary recrystallization (step S7) becomes unstable. Therefore, the N content is set to 0.003 mass % to 0.006 mass %.

S, Se: 0.013 mass % to 0.022 mass % as S equivalent

S and Se bond to Mn and/or Cu, and compounds of S and Se with Mn and/or Cu function as the primary inhibitors. Further, the compounds thereof are also useful as precipitation nuclei of AlN. When an S content is set as [S] and a Se content is set as [Se], an S equivalent Seq of the content of S and Se is represented by "[S]+0.406×[Se]", and when the content of S and Se exceeds 0.022 mass % when converted into the S equivalent Seq, there is a need to increase the temperature for heating the slab (step S1) in order to achieve secure solid-solution. When the content of S and Se is less than 0.013 mass % when converted into the S equivalent Seq, the primary inhibitors cannot be sufficiently precipitated (step S3), and the secondary recrystallization (step S7) becomes unstable. Therefore, the content of S and Se is set to 0.013 mass % to 0.022 mass % when converted into the S equivalent Seq.

Ti: 0.005 mass % or less

Ti bonds to N to form TiN. Further, when a Ti content exceeds 0.005 mass %, an amount of N that contributes to the formation of AlN becomes insufficient, resulting in that the primary inhibitors and the secondary inhibitors become insufficient. As a result of this, the secondary recrystallization (step S7) becomes unstable. Further, TiN remains even after the finish annealing (step S7) is performed, thereby deteriorating magnetic property (especially iron loss). Therefore, the Ti content is set to 0.005 mass % or less.

Cu: 0.05 mass % to 0.3 mass %

When the heating of slab (step S1) is performed at 1280° C. or higher, Cu forms fine precipitates together with S and Se (Cu—S, Cu—Se), and the precipitates function as inhibitors. Further, the precipitates also function as precipitation nuclei that make AlN functioning as the secondary inhibitor to be more uniformly dispersed. For this reason, the precipitates containing Cu contribute to the stabilization of secondary recrystallization (step S7). When a Cu content is less than 0.05 mass %, it is difficult to obtain these effects. When the Cu content exceeds 0.3 mass %, these effects saturate, and further, a surface flaw called "copper scab" may be generated at the time of hot rolling (step S2). Therefore, the Cu content is preferably 0.05 mass % to 0.3 mass %.

Sn, Sb: 0.02 mass % to 0.30 mass % in total

Sn and Sb are effective for improving the texture of the primary recrystallization (step S5). Further, Sn and Sb are grain boundary segregation elements, which stabilize the secondary recrystallization (step S7) and reduce the grain diameters of the crystal grains obtained through the secondary recrystallization. When a content of Sn and Sb is less than 0.02 mass % in total, it is difficult to obtain these effects. When the content of Sn and Sb exceeds 0.30 mass % in total, the cold-rolled steel strip is hard to be oxidized at the time of decarburization treatment (step S5), resulting in that the oxide layer is not sufficiently formed. Further, the decarburization is sometimes difficult to be performed. Therefore, the content of Sn and Sb is preferably 0.02 mass % to 0.30 mass % in total.

Note that P also exhibits the similar effect, but, it easily causes embrittlement. For this reason, a P content is preferably 0.020 mass % to 0.030 mass %.

Cr: 0.02 mass % to 0.30 mass %

Cr is effective for forming a good oxide layer at the time of decarburization treatment (step S5). The oxide layer contributes to the formation of glass film, which gives the surface tension on the grain-oriented electrical steel sheet. When a Cr content is less than 0.02 mass %, it is difficult to obtain this effect. When the Cr content exceeds 0.30 mass %, during the decarburization treatment (step S5), the cold-rolled steel strip is hard to be oxidized, resulting in that the oxide layer is not sufficiently formed and the decarburization is sometimes difficult to be performed. Therefore, the Cr content is preferably 0.02 mass % to 0.30 mass %.

It is also possible that other elements are contained for improving various properties of the grain-oriented electrical steel sheet. Further, a balance of the slab is preferably composed of Fe and inevitable impurities.

For example, Ni exhibits a significant effect for making the precipitates functioning as the primary inhibitors and the precipitates as the secondary inhibitors to be uniformly dispersed, and if an appropriate amount of Ni is contained, it becomes easy to obtain good and stable magnetic property. When a Ni content is less than 0.02 mass %, it is difficult to achieve this effect. When the Ni content exceeds 0.3 mass %, during the decarburization treatment (step S5), the cold-rolled steel strip is hard to be oxidized, resulting in that the oxide layer is not sufficiently formed and the decarburization is sometimes difficult to be performed.

Further, Mo and Cd form a sulfide or a selenide, and the precipitates thereof may function as inhibitors. When a content of Mo and Cd is less than 0.008 mass % in total amount, it is difficult to achieve this effect. When the content of Mo and Cd exceeds 0.3 mass % in total amount, the precipitates become coarse and thus do not function as the inhibitors, resulting in that the magnetic properties are not stabilized.

(Conditions of Manufacturing Procedure)

Next, conditions of respective manufacturing procedure shown in FIG. 1 will be described.

Step S1

In step S1, heating of slab having the composition as described above is conducted. A method of obtaining the slab is not particularly limited. For example, it is possible to produce the slab through a continuous casting method. Further, it is also possible to adopt a breaking down (slabbing) method for easily conducting the heating of slab. By adopting the breaking down method, it is possible to reduce a carbon content. Concretely, a slab having an initial thickness of 150 mm to 300 mm, preferably 200 mm to 250 mm, is manufactured through the continuous casting method. Further, it is also possible to produce a so-called thin slab by setting the initial thickness of the slab to about 30 mm to 70 mm. When the thin slab method is adopted, it becomes possible to simplify or omit rough rolling to an intermediate thickness at the time of hot rolling (step S2).

A temperature for heating the slab is set to a temperature at which a substance functioning as an inhibitor in the slab is solid-solved (made into solution), which is, for example, 1280° C. or higher. As the substance functioning as the inhibitor, AlN, MnS, MnSe, Cu—S and the like can be cited. If a slab is heated at a temperature lower than the temperature at which the substance functioning as the inhibitor in the slab is solid-solved, the substance is precipitated non-uniformly, which sometimes leads to a generation of so-called skid mark in the final product.

Note that an upper limit of the temperature for heating the slab is not particularly limited in terms of metallurgy. However, if the heating of slab is conducted at 1390° C. or higher, various difficulties regarding facilities and operations may arise. For this reason, the heating of slab is conducted at 1390° C. or lower.

A method of heating the slab is not particularly limited. For instance, it is possible to adopt methods of gas heating, induction heating, direct current heating and the like. Further, in order to easily conduct heating in these methods, it is also possible to perform breakdown on the casting slab. Further, if the temperature for heating the slab is set to 1300° C. or higher, it is also possible to use the breakdown to improve the texture to reduce the amount of carbon.

Step S2

In step S2, the slab after being heated is hot-rolled, thereby obtaining a hot-rolled steel strip.

At this time, a ratio of N, contained in the slab, that is precipitated as AlN in the hot-rolled steel strip (precipitation rate of N) is set to 35% or less. When the precipitation rate of N exceeds 35%, precipitates, which are coarse after the annealing (step S3) and do not function as the primary inhibitors, increase, and thus fine precipitates functioning as the primary inhibitors become insufficient. When such fine precipitates (primary inhibitors) are insufficient, the secondary recrystallinity (step S7) becomes unstable.

Note that the precipitation rate of N can be adjusted by a cooling condition in the hot rolling. Specifically, if a temperature at which cooling is started is set high and a cooling rate is also set quick, the precipitation rate is reduced. A lower limit of the precipitation rate is not particularly limited, but, it is difficult to set the ratio to less than 3%.

Further, a ratio of S and/or Se, contained in the slab, that are/is precipitated as MnS or MnSe in the hot-rolled steel strip (precipitation rate of S and Se as compounds with Mn) is set to 45% or less as the S equivalent Seq. When the precipitation rate of S and Se as compounds with Mn exceeds 45% as the S equivalent, the precipitation at the time of hot rolling becomes non-uniform. Further, the precipitates become coarse and difficult to function as effective inhibitors in the secondary recrystallization (step S7).

Step S3

In step S3, the hot-rolled steel strip is annealed, and precipitates such as AlN, MnS and MnSe (primary inhibitors) are formed.

This annealing is performed to uniformize the non-uniform structure in the hot-rolled steel strip mainly generated during the hot rolling, to precipitate the primary inhibitors and to disperse the inhibitors in a fine form. Note that the condition at the time of annealing is not particularly limited. For instance, a condition described in Patent Document 17, Patent Document 18, Patent Document 10 or the like can be applied.

Further, a cooling condition in the annealing is not particularly limited, but, it is preferable to set a cooling rate from 700° C. to 300° C. to 10° C./second or more, in order to securely achieve fine primary inhibitors and to secure a quenched hard phase.

Note that if Cu is contained in the slab, a ratio of S and/or Se, contained in the steel strip after the annealing, that are/is precipitated as Cu—S or Cu—Se (precipitation rate of S and Se as compounds with Cu) is preferably set to 25% to 60% as the S equivalent Seq. The precipitation rate of S and Se as compounds with Cu often becomes less than 25% when the cooling in the annealing is conducted at a very fast speed. Further, when the cooling in the annealing is performed at a very fast speed, the precipitation of primary inhibitors often becomes insufficient. Accordingly, when the precipitation rate of S and Se as compounds with Cu is less than 25%, the secondary recrystallization (step S7) is likely to be unstable. When the precipitation rate of S and Se as compounds with Cu exceeds 60%, the number of coarse precipitates is large, resulting in that fine precipitates functioning as the primary inhibitors are likely to be insufficient. For this reason, the secondary recrystallization (step S7) is likely to be unstable.

Step S4

In step S4, the annealed steel strip is cold-rolled, thereby obtaining a cold-rolled steel strip.

The number of times of cold rolling is not particularly limited. Note that if the cold rolling is performed only once, the annealing of the hot-rolled steel strip (step S3) is performed before the cold rolling as an annealing before final cold rolling. Further, if a plurality of times of cold rolling are performed, it is preferable that an intermediate annealing is conducted between the processes of cold rolling. If the plurality of times of cold rolling is performed, it is also possible to omit the annealing in step S3 and form the primary inhibitors in the intermediate annealing.

Further, a rolling rate in the last-performed one of the cold rolling (final cold rolling) is set to 84% to 92%. When the rolling rate at the time of final cold rolling is less than 84%, the sharpness of the Goss orientation in the primary recrystallization texture obtained through the annealing (step S5) is broad, and further, the intensity in the Σ9 coincident orientation of Goss becomes weak. As a result of this, high magnetic flux density cannot be obtained. When the rolling rate at the time of final cold rolling exceeds 92%, the number of crystal grains of the Goss orientation in the texture obtained through the primary recrystallization (step S5) becomes extremely small, resulting in that the secondary recrystallization (step S7) becomes unstable.

The condition of the final cold rolling is not particularly limited. For instance, the final cold rolling may also be conducted at room temperature. Further, if a temperature during at least one pass is maintained in a range of 100° C. to 300° C. for one minute or more, the texture obtained through the primary recrystallization (step S5) is improved, and quite good magnetic property is provided. This is described in Patent Document 19 and the like.

Step S5

In step S5, the cold-rolled steel strip is annealed, and during this process of annealing, decarburization is performed to cause the primary recrystallization. Further, as a result of performing the annealing, an oxide layer is formed on a surface of the cold-rolled steel strip. An average grain diameter (diameter of circle-equivalent area) of crystal grains obtained through the primary recrystallization is set to not less than 8 μm nor more than 15 μm. When the average grain diameter of the primary recrystallization grains is less than 8 μm, a temperature at which the secondary recrystallization occurs during the finish annealing (step S7) becomes quite low. Specifically, the secondary recrystallization occurs at a low temperature. As a result of this, the sharpness of the Goss orientation is deteriorated. When the average grain diameter of the primary recrystallization grains exceeds 15 μm, a temperature at which the secondary recrystallization occurs during the finish annealing (step S7) becomes high. As a result of this, the secondary recrystallization (step S7) becomes unstable. Note that if the temperature for heating the slab (step S1) is set to 1280° C. or higher to make the substance functioning as the inhibitor to be completely solid-solved, the average grain diameter of the primary recrystallization grains becomes approximately not less than 8 μm nor more than 15 μm even if the temperature at the time of annealing before final cold rolling (step S3) and the temperature at the time of annealing (step S5) are changed.

In terms of grain growth, the smaller the primary recrystallization grains, the larger the absolute number of crystal grains of the Goss orientation to be nuclei for the secondary recrystallization, at the stage of primary recrystallization. For instance, if the average grain diameter of the primary recrystallization grains is not less than 8 μm nor more than 15 μm, the absolute number of crystal grains of the Goss orientation is about five times more than that in a case where the average grain diameter of the primary recrystallization grains after the decarburization annealing is completed is 18 μm to 35 μm (Patent Document 20). Further, the smaller the primary recrystallization grains, the smaller the crystal grains obtained through the secondary recrystallization (secondary recrystallization grains). By these synergistic effects, iron loss of the grain-oriented electrical steel sheet is ameliorated, and further, crystal grains oriented in the Goss orientation are selectively grown, resulting in that magnetic flux density is improved.

The condition during the annealing in step S5 is not particularly limited, and a conventional one may also be used. For instance, it is possible to perform annealing at 650° C. to 950° C. for 80 seconds to 500 seconds in a wet atmosphere of mixed nitrogen and hydrogen. It is also possible to adjust a period of time and the like in accordance with a thickness of the cold-rolled steel strip. Further, it is preferable that a heating rate from the start of the temperature rise up to 650° C. or higher is set to 100° C./second or more. This is because the primary recrystallization texture is improved and better magnetic property is provided. A method of conducting heating at 100° C./second or more is not particularly limited, and, for instance, methods of resistance heating, induction heating, directly energy input heating and the like can be employed.

If the heating rate is increased, the number of crystal grains of the Goss orientation in the primary recrystallization texture becomes large, and the secondary recrystallization grains become small. This effect can also be achieved when the heating rate is around 100° C./second, but, it is more preferable to set the heating rate to 150° C./second or more.

Step S6

In step S6, nitriding treatment is performed on the steel strip after the primary recrystallization. In the nitriding treatment, N that bonds to the acid-soluble Al is introduced into the steel strip, to thereby form the secondary inhibitors. At this time, if the introduction amount of N is too small, the secondary recrystallization (step S7) becomes unstable. If the introduction amount of N is too large, the sharpness of the Goss orientation is quite deteriorated, and further, a glass film defect in which a base iron is exposed often occurs. Accordingly, conditions as described below are set on the introduction amount of N.

Regarding the contents of Mn, S and Se in the slab, a value A defined by an equation (1) satisfies an equation (2). Here, [Mn] represents the Mn content.

[Mathematical expression 3]

$$A=([Mn]/54.9)/(Seq/32.1) \quad \text{equation (1)}$$

$$1.6 \leqq A \leqq 2.3 \quad \text{equation (2)}$$

Further, a value I defined by an equation (3) satisfies an equation (4). Here, [N] represents the N content in the slab, and ΔN represents an increasing amount of the N content in the nitriding treatment.

[Mathematical expression 4]

$$I=1.3636\times[Seq]/32.1+0.5337\times[N]/14.0+0.7131\times\Delta N/14. \quad \text{equation (3)}$$

$$0.0011 \leqq I \leqq 0.0017 \quad \text{equation (4)}$$

If such conditions are satisfied, the secondary inhibitors are appropriately formed, the secondary recrystallization (step S7) is stabilized, and the texture having a superior sharpness of the Goss orientation can be obtained.

When the value A is less than 1.6, the secondary recrystallization (step S7) becomes unstable. When the value A exceeds 2.3, it is not possible to make the substance functioning as the inhibitor to be solid-solved, unless the temperature for heating the slab (step S1) is set extremely high (set to higher than 1390° C.)

When the value I is less than 0.0011, the total amount of inhibitors is insufficient, resulting in that the secondary recrystallization (step S7) becomes unstable. When the value I exceeds 0.0017, the total amount of inhibitors becomes too much, which deteriorates the sharpness of the Goss orientation in the texture in the secondary recrystallization (step S7), and it becomes difficult to achieve good magnetic property.

Note that the amount of N contained in the steel strip after the nitriding treatment is preferably greater than the amount of N that forms AlN. This is for realizing the stabilization of secondary recrystallization (step S7). Although it is not clarified why such a N content enables the stabilization of secondary recrystallization (step S7), the reason can be estimated as follows. In the finish annealing (step S7), since the temperature of the steel strip becomes high, AlN functioning as the secondary inhibitor is sometimes decomposed or solid-solved. This phenomenon occurs as denitrification since N is more easily diffused than aluminum. For this reason, the denitrification is facilitated as the amount of N contained in the steel strip after the niriding treatment is smaller, resulting in that an action of the secondary inhibitor easily disappears in an early stage. This denitrification becomes hard to occur when the amount of N contained in the steel strip after the nitriding treatment is greater than the amount of N that forms AlN. Thereby, the decomposition and solid-solution of AlN become hard to occur. Therefore, a sufficient amount of AlN functions as the secondary inhibitors. Further, when adjusting the amount of N as described above, it is preferable to take the equations (3) and (4) into consideration.

Note that when a large amount of Ti is contained in the steel strip (for instance, when the Ti content exceeds 0.005 mass %), a large amount of TiN is formed in the nitriding treatment, and is remained even after the finish annealing (step S7) is performed, so that magnetic property (particularly, iron loss) is sometimes deteriorated.

A method in the nitriding treatment is not particularly limited, and there can be cited a method in which nitrides (CrN and MnN, and the like) are mixed in an annealing separating agent and nitriding is performed in high-temperature annealing, and a method in which a strip (steel strip) is nitrided, while being running, in a mixed gas of hydrogen, nitrogen and ammonia. The latter method is preferable in terms of industrial production.

Further, the nitriding treatment is preferably performed on both surfaces of the steel strip after the primary recrystallization. In the present embodiment, the grain diameter of the primary recrystallization grain is about not less than 8 μm nor more than 15 μm and the N content in the slab is 0.003 mass % to 0.006 mass %. Accordingly, the temperature at which the secondary recrystallization (step S7) is started is low to be 1000° C. or lower. Therefore, in order to obtain the superior texture of the Goss orientation through the secondary recrystallization, it is preferable that the inhibitors uniformly disperse along the entire thickness direction. For this reason, N is preferably diffused in the steel strip in an early stage, and the nitriding treatment is preferably performed substantially equally on both surfaces of the steel strip.

For example, if a nitrogen content of a 20% thickness portion of one surface of the steel strip is set as σN1 (mass %), and a nitrogen content of a 20% thickness portion of the other surface of the steel strip is set as σN2 (mass %), a value B defined by an equation (5) preferably satisfies an equation (6).

[Mathematical expression 5]

$$B=|\sigma N1-\sigma N2|/\Delta N \quad \text{equation (5)}$$

$$B \leqq 0.35 \quad \text{equation (6)}$$

In the present embodiment, the primary recrystallization grain is small and the temperature at which the secondary recrystallization (step S7) is started is low, so that when the value B exceeds 0.35, the secondary recrystallization is started before N is diffused in the entire steel strip, resulting in that the secondary recrystallization becomes unstable. Further, since N is not diffused uniformly in the thickness direction, the nuclei for the secondary recrystallization are generated at positions separated from a surface layer portion, resulting in that the sharpness of the Goss orientation deteriorates.

Figure 2:
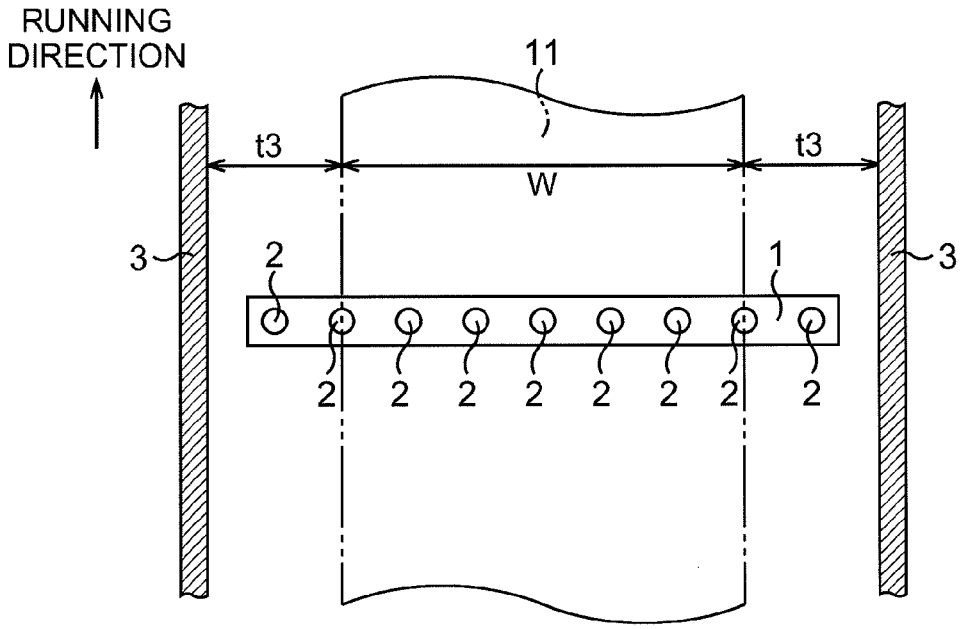
FIG. 2 is a sectional view showing a structure of a nitriding furnace.
Figure 3:
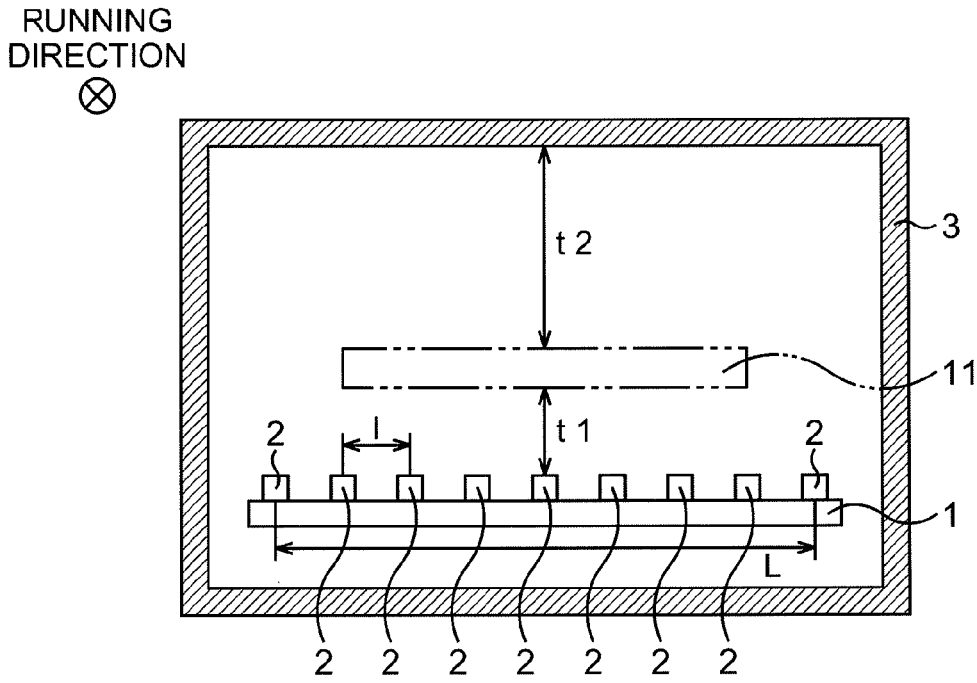
FIG. 3 is a sectional view similarly showing the structure of the nitriding furnace.

Here, a nitriding furnace suitably employed in the nitriding treatment in step S6 will be described. FIG. 2 and FIG. 3 are sectional views showing a structure of the nitriding furnace, and show cross sections orthogonal to each other.

As shown in FIG. 2 and FIG. 3, a pipe 1 is provided in a furnace shell 3 in which a strip 11 runs. The pipe 1 is provided below a space through which the strip 11 runs (strip pass line), for example. The pipe 1 extends in a direction that intersects with a running direction of the strip 11, which is, for instance, a direction orthogonal to the running direction, and is provided with a plurality of nozzles 2 facing upward. Further, ammonia gas is ejected in the furnace shell 3 from the nozzles 2. Note that regarding the arrangement of the nozzles 2, it is preferable that equation (7) to equation (11) are satisfied. Here, t1 represents a shortest distance between a tip of the nozzle 2 and the strip 11, t2 represents a distance between the strip 11 and a ceiling portion (wall portion) of the furnace shell 3, and t3 represents distances between both edge portions in a width direction of the strip 11 and wall portions of the furnace shell 3. Further, W represents a width of the strip 11, L represents a maximum width between the nozzles 2 located at both ends, and l represents a center-to-center distance between adjacent nozzles 2. The width W of the strip 11 is, for instance, 900 mm or more.

[Mathematical expression 6]

$$t1 \geqq 50 \text{ mm} \quad \text{equation (7)}$$

$$1 \leqq t1 \quad \text{equation (8)}$$

$$t2 \geqq 2 \times t1 \quad \text{equation (9)}$$

$$t3 \geqq 2.5 \times t1 \quad \text{equation (10)}$$

$$L \geqq 1.2 \times W \quad \text{equation (11)}$$

When the nitriding treatment is conducted by using such a nitriding furnace, almost no variation in the ammonia concentration occurs in the furnace shell 3, and it is possible to easily reduce the value B to 0.35 or less. Note that in the example shown in FIG. 2 and FIG. 3, the nozzles 2 are provided only below the strip 11, but, they may also be provided only above the strip, or both above and below the strip. Although illustration is omitted in FIG. 2 and FIG. 3, various gas pipes and wirings for control system device and the like are provided in an actual nitriding furnace, which sometimes makes it difficult to provide the nozzles 2 both above and below the strip. Also in such a case, according to the example shown in FIG. 2 and FIG. 3, by providing the nozzles 2 only either above or below the strip, it is possible to satisfy the relations in the equations (5) and (6). Specifically, when compared to a case where the nozzles are provided both above and below the strip, it is possible to reduce an investment in the nitriding furnace.

Note that it is also possible that a plurality of the pipes 1 shown in FIG. 2 and FIG. 3 is provided along the running direction of the strip 11. When a running speed of the strip 11 is fast, if only one pipe 1 is used, it sometimes becomes difficult to perform sufficient nitriding treatment, but, by using a plurality of the pipes 1, it becomes possible to securely perform the nitriding treatment to appropriately generate the secondary inhibitors.

Figure 4:
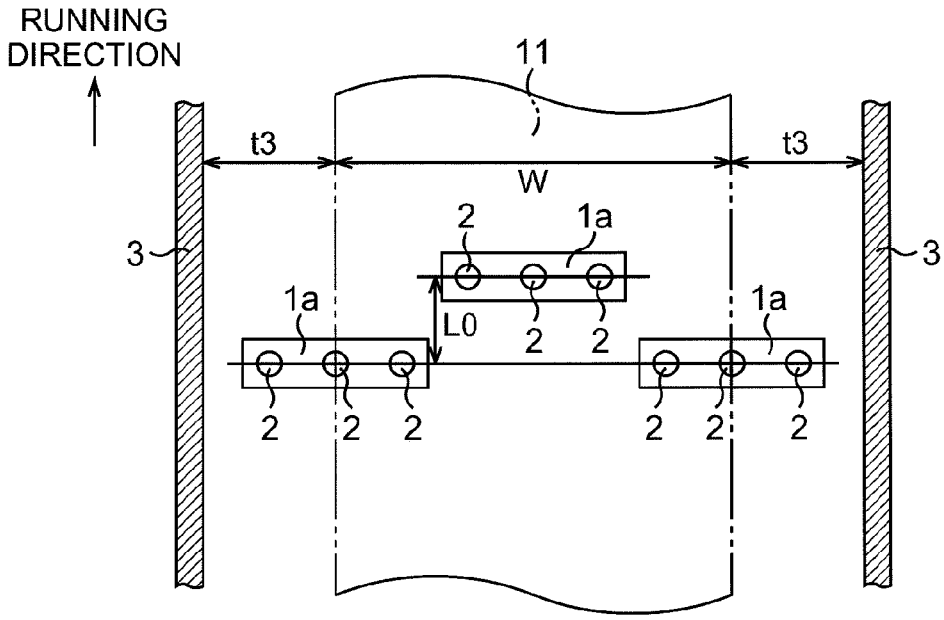
FIG. 4 is a sectional view showing a structure of another nitriding furnace.

Further, the pipe 1 may also be divided into a plurality of units. For example, it is also possible that three pipe units 1*a* formed by dividing the pipe 1 are provided, as shown in FIG. 4. As the number of nozzles provided to one pipe (unit) is larger, the pressures of ammonia gas ejected from the nozzles are likely to vary. When comparing the example shown in FIG. 2 and FIG. 3 with the example shown in FIG. 4, since, in the example of FIG. 4, the number of nozzles 2 provided to one pipe unit 1*a* is smaller than the number of nozzles 2 provided to the pipe 1, it becomes possible to perform more uniform nitriding in the width direction.

Note that a distance L0 between adjacent pipe units 1*a* in the running direction of the strip 11 is preferably 550 mm or less. When the distance L0 exceeds 550 mm, the level of nitriding in the width direction of the strip is likely to be non-uniform, resulting in that the secondary recrystallization is likely to be non-uniform.

Figure 5:
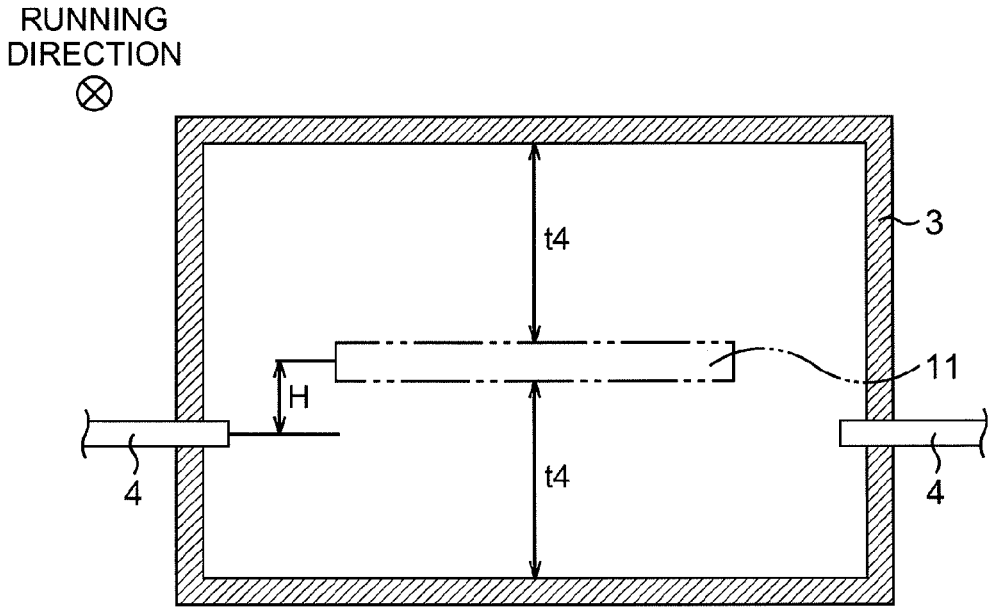
FIG. 5 is a sectional view showing a structure of still another nitriding furnace.

Further, it is also possible that the introduction of ammonia gas into the furnace shell 3 is performed through inlet ports 4 provided to wall portions of the furnace shell 3, as shown in FIG. 5. In this case, regarding the arrangement of the inlet ports 4, it is preferable that equation (12) to equation (14) are satisfied. Here, t4 represents a shortest distance between the strip 11 and a ceiling portion or a floor portion (wall portion) of the furnace shell 3, and H represents a vertical distance between a space through which the strip 11 runs and the inlet port 4.

[Mathematical expression 7]

$$t3 \geqq W/3 \quad \text{equation (12)}$$

$$t4 \geqq 100 \text{ mm} \quad \text{equation (13)}$$

$$H \leqq W/3 \quad \text{equation (14)}$$

By conducting the nitriding treatment using such a nitriding furnace, it is possible to easily reduce the value B to 0.35 or less.

The inlet ports 4 are preferably provided on both sides in the width direction of the strip 11. This is for easily enabling the concentration of ammonia gas in the furnace shell 3 to be more uniform. Further, in order to realize more uniform nitriding, the inlet ports 4 are preferably provided at substantially the same height as the strip 11, but, it is possible to perform generally good nitriding as long as the equation (14) is satisfied.

Note that in the examples shown in FIG. 2 to FIG. 5, the running direction of the strip 11 is a horizontal direction. However, the running direction of the strip 11 may also be inclined from the horizontal direction, and may also be a vertical direction, for example. In either case, it is preferable that the above-described conditions are satisfied.

Step S7

In step S7, the finish annealing after coating an annealing separating agent whose main component is, for instance, MgO (annealing separating agent containing 90 mass % or more of MgO, for example) is performed, to thereby cause the secondary recrystallization.

At this time, the primary inhibitors (AlN, MnS, MnSe and Cu—S formed in step S3) and the secondary inhibitors (AlN formed in step S6) control the secondary recrystallization. Specifically, with the use of the primary inhibitors and the secondary inhibitors, preferred growth in the Goss orientation in the thickness direction is facilitated, resulting in that magnetic property is remarkably improved. Further, the secondary recrystallization is started at a position close to the surface layer of the steel strip. Further, in the present embodiment, amounts of the primary inhibitors and the secondary inhibitors are appropriately set, and the grain diameter of the primary recrystallization grain is about not less than 8 μm nor more than 15 μm. For this reason, the driving force for grain boundary migration (grain growth: secondary recrystallization) becomes large, resulting in that the secondary recrystallization is started in a further early stage of the stage of temperature rise (at a lower temperature) in the finish annealing. Further, the selectivity of the second recrystallization grains of the Goss orientation in the thickness direction of the steel strip is increased. As a result of this, the sharpness of the Goss orientation of the texture obtained through the secondary recrystallization becomes superior. Specifically, the secondary recrystallization stably occurs, resulting in that good magnetic property can be achieved.

Further, the finish annealing for the secondary recrystallization is performed in a box-type annealing furnace, for example. At this time, the steel strip after the nitriding treatment is in a coil shape and has a limited weight (size). In order to improve productivity in such finish annealing, it can be considered to increase the weight per coil. However, if the weight of the coil is increased, a temperature hysteresis is likely to largely differ among positions of the coil. Particularly, since a maximum temperature in the finish annealing is limited because of the specification of the facility, when the temperature at which the secondary recrystallization is started becomes high, a difference in the temperature hysteresis between a coldest point and a hottest point in the coil becomes significantly large. Therefore, the secondary recrystallization is preferably started at a time at which the difference in the temperature hysteresis is hardly generated, namely, at a time of temperature rise. If the secondary recrystallization is started at the time of temperature rise, the non-uniformity of magnetic property between the positions on the coil is significantly reduced, the annealing condition is easily set, and the magnetic property is quite highly stabilized. In the present embodiment, the temperature at which the secondary recrystallization is started becomes relatively low, which is also effective in an actual operation.

After conducting step S7, a coating of an insulation tension coating, a flattening treatment and the like are performed, for instance.

According to the present embodiment, it is possible to improve the state of inhibitors to obtain good magnetic property. As important indexes of magnetic property in the grain-oriented electrical steel sheet, there can be cited iron loss, magnetic flux density and magnetostriction. When the sharpness of the Goss orientation and the magnetic flux density are high, the iron loss can be improved utilizing magnetic domain control technology. The magnetostriction can be reduced (improved) when the magnetic flux density is high. When the magnetic flux density in the grain-oriented electrical steel sheet is high, it is possible to relatively reduce an exciting current in a transformer manufactured with the grain-oriented electrical steel sheet, so that the transformer can be made smaller in size.

As above, the magnetic flux density is important magnetic property in the grain-oriented electrical steel sheet. Further, according to the present embodiment, it is possible to stably manufacture a grain-oriented electrical steel sheet whose magnetic flux density ($B_8$) is 1.92 T or more. Here, the magnetic flux density ($B_8$) corresponds to one in a magnetic field of 800 A/m.

Note that regarding the production of slab, a thin slab casting and a steel strip casting (strip caster) have been put into practical use in recent years, as technology to supplement ordinary continuous hot rolling, and it is also possible to conduct these castings. However, in these castings, so-called "center segregation" occurs at the time of solidification, and it is quite difficult to obtain a good uniform solid-solution state. Accordingly, when these castings are employed, in order to obtain a good uniform solid-solution state, it is preferable to perform solid-solution heat treatment before conducting the hot rolling (step S2).

EXAMPLE

Experimental Example 1

Slabs each composed of components shown in Table 1 were melted and the slabs were heated at 1300° C. to 1350° C. (step S1).

TABLE 1

| | No. | C | Si | Mn | ACID-SOLUBLE Al | N | S | Se | Ti | Sn | Sb | Cu | VALUE A |
|---|---|---|---|---|---|---|---|---|---|---|---|---|---|
| COMPARATIVE EXAMPLE | 1 | 0.071 | 3.38 | 0.046 | 0.0255 | 0.0028 | 0.018 | | 0.0021 | 0.09 | | 0.08 | 1.49 |
| COMPARATIVE EXAMPLE | 2 | 0.035 | 3.38 | 0.046 | 0.0255 | 0.0046 | 0.018 | | 0.0021 | 0.09 | | 0.08 | 1.49 |
| EXAMPLE | 3 | 0.071 | 3.38 | 0.050 | 0.0255 | 0.0046 | 0.018 | | 0.0021 | 0.08 | | 0.08 | 1.62 |
| EXAMPLE | 4 | 0.071 | 3.38 | 0.050 | 0.0255 | 0.0046 | 0.018 | | 0.0021 | 0.08 | | 0.08 | 1.62 |
| COMPARATIVE EXAMPLE | 5 | 0.068 | 3.22 | 0.044 | 0.0250 | 0.0044 | 0.011 | | 0.0070 | 0.10 | | 0.11 | 2.34 |
| COMPARATIVE EXAMPLE | 6 | 0.068 | 3.22 | 0.044 | 0.0250 | 0.0044 | 0.011 | | 0.0070 | 0.10 | | 0.11 | 2.34 |
| EXAMPLE | 7 | 0.058 | 3.15 | 0.043 | 0.0270 | 0.0050 | 0.007 | 0.019 | 0.0015 | 0.08 | | 0.15 | 1.71 |
| EXAMPLE | 8 | 0.058 | 3.15 | 0.043 | 0.0270 | 0.0050 | 0.007 | 0.019 | 0.0015 | 0.08 | | 0.15 | 1.71 |
| EXAMPLE | 9 | 0.065 | 3.35 | 0.048 | 0.0257 | 0.0047 | 0.017 | | 0.0023 | | | | 1.65 |
| EXAMPLE | 10 | 0.072 | 3.33 | 0.051 | 0.0260 | 0.0044 | 0.018 | | 0.0018 | 0.07 | | 0.10 | 1.66 |

UNIT OF CONTENT OF EACH ELEMENT: MASS %

Next, hot rolling was conducted (step S2), thereby obtaining hot-rolled steel strips each having a thickness of 2.3 mm. Regarding the hot rolling, in order to suppress the precipitation of substances functioning as inhibitors (AlN, MnS, Cu—S and MnSe) as much as possible, finish hot rolling was started at a temperature exceeding 1050° C., and after the completion of finish hot rolling, quick cooling was performed. Thereafter, the hot-rolled steel strips were subjected to continuous annealing at 1120° C. for 60 seconds, and were cooled at 20° C./second (step S3). Subsequently, the steel strips were subjected to cold rolling at 200° C. to 250° C., thereby obtaining cold-rolled steel strips each having a thickness of 0.285 mm (step S4). Next, the steel strips were heated up to 800° C. at 180° C./second, heated from 800° C. up to 850° C. at about 20° C./second, and annealed, for decarburization and primary recrystallization, at 850° C. for 150 seconds in a mixed atmosphere of $H_2$ and $N_2$ at a dew point of 65° C. (step S5). Thereafter, nitriding treatment was performed on the steel strips, while running the strips (steel strips), in an ammonia atmosphere in which ammonia was introduced from directions above and below the strips (step S6). At this time, an introduction amount of ammonia introduced into the atmosphere was changed in various ways to change an amount of nitriding.

Subsequently, an annealing separating agent having MgO as its main component was coated on both surfaces of the steel strips after the nitriding treatment, and finish annealing was conducted to cause secondary recrystallization (step S7). Specifically, secondary recrystallization annealing was performed. The finish annealing was conducted in an atmosphere in which a ratio of $N_2$ was 25 vol % and a ratio of $H_2$ was 75 vol %, and a temperature of the steel strips was raised up to 1200° C. at 10° C./hour to 20° C./hour. Next, purification treatment was performed at a temperature of 1200° C. for 20 hours or more, in an atmosphere in which a ratio of $H_2$ was 100 vol %. Further, a coating of an insulation tension coating, and a flattening treatment were performed.

In such a series of treatment processes, various precipitation rates and increasing amounts of nitriding and magnetic properties in the obtained grain-oriented electrical steel sheets were measured. Results thereof are shown in Table 2.

TABLE 2

| | No. | TEMPERATURE FOR HEATING SLAB (° C.) | PRECIPITATION RATE OF N (%) (N as AlN) | PRECIPITATION RATE OF S AND Se AS COMPOUNDS WITH Mn (%) | PRECIPITATION RATE OF S AND Se AS COMPOUNDS WITH Cu (%) | VALUE I |
|---|---|---|---|---|---|---|
| COMPARATIVE EXAMPLE | 1 | 1300 | 13 | 35 | 30 | 0.0010 |
| COMPARATIVE EXAMPLE | 2 | 1300 | 13 | 35 | 30 | 0.0015 |
| EXAMPLE | 3 | 1300 | 12 | 33 | 32 | 0.0014 |
| EXAMPLE | 4 | 1300 | 12 | 33 | 32 | 0.0015 |
| COMPARATIVE EXAMPLE | 5 | 1350 | 20 | 25 | 45 | 0.0010 |
| COMPARATIVE EXAMPLE | 6 | 1350 | 20 | 25 | 45 | 0.0013 |
| EXAMPLE | 7 | 1320 | 12 | 20 | 50 | 0.0014 |
| EXAMPLE | 8 | 1320 | 12 | 20 | 50 | 0.0015 |
| EXAMPLE | 9 | 1300 | 9 | 27 | | 0.0014 |
| EXAMPLE | 10 | 1300 | 9 | 27 | 40 | 0.0015 |

| | No. | ΔN (MASS %) | TOTAL CONTENT OF N (MASS %) | AVERAGE GRAIN DIAMETER OF PRIMARY RECRYSTALLIZATION GRAINS (μm) | MAGNETIC PROPERTIES (W17/50, $B_8$) |
|---|---|---|---|---|---|
| COMPARATIVE EXAMPLE | 1 | 0.0050 | 0.0096 | 13.0 | SECONDARY RECRYSTALLIZATION WAS UNSTABLE AND POOR |
| COMPARATIVE EXAMPLE | 2 | 0.0105 | 0.0151 | 13.0 | SECONDARY RECRYSTALLIZATION WAS UNSTABLE AND POOR |
| EXAMPLE | 3 | 0.0098 | 0.0144 | 12.5 | 0.97 W/kg, 1.94 T |
| EXAMPLE | 4 | 0.0115 | 0.0161 | 12.5 | 0.96 W/kg, 1.95 T |
| COMPARATIVE EXAMPLE | 5 | 0.0065 | 0.0109 | 11.3 | SECONDARY RECRYSTALLIZATION WAS POOR |
| COMPARATIVE EXAMPLE | 6 | 0.0134 | 0.0178 | 11.3 | SECONDARY RECRYSTALLIZATION WAS POOR |
| EXAMPLE | 7 | 0.0110 | 0.016 | 10.5 | 1.02 W/kg, 1.92 T |
| EXAMPLE | 8 | 0.0140 | 0.019 | 10.5 | 0.98 W/kg, 1.95 T |
| EXAMPLE | 9 | 0.0100 | 0.0147 | 12.5 | 0.98 W/kg, 1.94 T |
| EXAMPLE | 10 | 0.0118 | 0.0162 | 11.3 | 0.97 W/kg, 1.95 T |

As shown in Table 2, in examples Nos. 3, 4, 7, 8, 9 and 10, high magnetic properties, especially, high magnetic flux density ($B_8$) were obtained.

Experimental Example 2

Slabs each composed of components shown in Table 3 were melted and the slabs were heated at 1200° C. to 1340° C. (step S1).

TABLE 3

| | No. | C | Si | Mn | ACID-SOLUBLE Al | N | S | Se | Ti | Sn | Sb | Cu | VALUE A |
|---|---|---|---|---|---|---|---|---|---|---|---|---|---|
| COMPARATIVE EXAMPLE | 11 | 0.067 | 3.35 | 0.045 | 0.0270 | 0.0048 | 0.015 | | 0.0017 | | | | 1.75 |
| COMPARATIVE EXAMPLE | 12 | 0.067 | 3.35 | 0.045 | 0.0270 | 0.0048 | 0.015 | | 0.0017 | | | | 1.75 |
| COMPARATIVE EXAMPLE | 13 | 0.075 | 3.37 | 0.078 | 0.0270 | 0.0082 | 0.025 | | 0.0025 | 0.08 | | 0.08 | 1.82 |
| COMPARATIVE EXAMPLE | 14 | 0.075 | 3.37 | 0.078 | 0.0270 | 0.0082 | 0.025 | | 0.0025 | 0.08 | | 0.08 | 1.82 |
| EXAMPLE | 15 | 0.075 | 3.30 | 0.053 | 0.0245 | 0.0047 | 0.016 | | 0.0022 | 0.10 | | 0.05 | 1.94 |
| EXAMPLE | 16 | 0.075 | 3.30 | 0.053 | 0.0245 | 0.0047 | 0.016 | | 0.0022 | 0.10 | | 0.05 | 1.94 |
| EXAMPLE | 17 | 0.063 | 3.27 | 0.060 | 0.0275 | 0.0041 | 0.020 | | 0.0015 | | 0.05 | 0.09 | 1.75 |
| COMPARATIVE EXAMPLE | 18 | 0.063 | 3.27 | 0.060 | 0.0275 | 0.0041 | 0.020 | | 0.0015 | | 0.05 | 0.09 | 1.75 |
| COMPARATIVE EXAMPLE | 19 | 0.067 | 3.24 | 0.056 | 0.0271 | 0.0042 | 0.012 | | 0.0010 | 0.08 | | 0.12 | 2.73 |
| COMPARATIVE EXAMPLE | 20 | 0.067 | 3.24 | 0.056 | 0.0271 | 0.0042 | 0.012 | | 0.0010 | 0.08 | | 0.12 | 2.73 |
| COMPARATIVE EXAMPLE | 21 | 0.071 | 3.38 | 0.050 | 0.0255 | 0.0046 | 0.018 | | 0.0021 | 0.11 | | 0.08 | 1.62 |
| COMPARATIVE EXAMPLE | 22 | 0.071 | 3.38 | 0.050 | 0.0255 | 0.0046 | 0.018 | | 0.0021 | 0.11 | | 0.08 | 1.62 |
| EXAMPLE | 23 | 0.058 | 3.15 | 0.043 | 0.0270 | 0.0050 | 0.007 | 0.019 | 0.0015 | 0.08 | | 0.15 | 1.71 |
| COMPARATIVE EXAMPLE | 24 | 0.058 | 3.15 | 0.043 | 0.0270 | 0.0050 | 0.007 | 0.019 | 0.0015 | 0.08 | | 0.15 | 1.71 |
| COMPARATIVE EXAMPLE | 25 | 0.075 | 3.30 | 0.053 | 0.0245 | 0.0047 | 0.016 | | 0.0022 | 0.10 | | 0.05 | 1.94 |
| EXAMPLE | 26 | 0.075 | 3.30 | 0.053 | 0.0245 | 0.0047 | 0.016 | | 0.0022 | 0.10 | | 0.05 | 1.94 |
| EXAMPLE | 27 | 0.063 | 3.27 | 0.060 | 0.0275 | 0.0041 | 0.020 | | 0.0015 | | 0.02 | 0.09 | 1.75 |
| EXAMPLE | 28 | 0.065 | 3.35 | 0.048 | 0.0257 | 0.0047 | 0.017 | | 0.0023 | | | | 1.65 |
| EXAMPLE | 29 | 0.072 | 3.33 | 0.051 | 0.0260 | 0.0044 | 0.018 | | 0.0018 | 0.07 | | 0.10 | 1.66 |

UNIT OF CONTENT OF EACH ELEMENT: MASS %

Next, cold-rolled steel strips were obtained in the same manner as the experimental example 1 (steps S2 to S4). After that, the steel strips were heated up to 800° C. at 180° C./second, heated from 800° C. up to 850° C. at about 20° C./second, and annealed, for decarburization and primary recrystallization, at 850° C. for 150 seconds in a mixed atmosphere of $H_2$ and $N_2$ at a dew point of 65° C. (step S5). Subsequently, the steel strips were subjected to nitriding treatment (step S6). At this time, an introduction amount of ammonia introduced into an atmosphere was changed in various ways to change an amount of nitriding. Further, regarding the steel strips in Nos. 11 to 20, the nitriding treatment was performed on the steel strips, while running the strips (steel strips), in an ammonia atmosphere in which ammonia was introduced from directions above and below the strips, in the same manner as the experimental example 1. Further, regarding the steel strips in Nos. 21 to 29, the nitriding treatment was performed on the steel strips, while running the strips (steel strips), in an ammonia atmosphere in which ammonia was introduced only from a direction above the strips.

Subsequently, an annealing separating agent having MgO as its main component was coated on both surfaces of the steel strips after the nitriding treatment, and finish annealing was conducted to cause secondary recrystallization (step S7). Specifically, secondary recrystallization annealing was performed. The finish annealing was conducted in an atmosphere in which a ratio of $N_2$ was 25 vol % and a ratio of $H_2$ was 75 vol %, and a temperature of the steel strips was raised up to 1200° C. at 10 to 20° C./hour.

In such a series of treatment processes, various precipitation rates and increasing amounts of nitriding and magnetic properties in the obtained grain-oriented electrical steel sheets were measured. Results thereof are shown in Table 4.

TABLE 4

| | No. | TEMPERATURE FOR HEATING SLAB (° C.) | PRECIPITATION RATE OF N (%) (N as AlN) | PRECIPITATION RATE OF S AND Se AS COMPOUNDS WITH Mn (%) | PRECIPITATION RATE OF S AND Se AS COMPOUNDS WITH Cu (%) | VALUE I |
|---|---|---|---|---|---|---|
| COMPARATIVE EXAMPLE | 11 | 1200 | 60 | 50 | | 0.0014 |
| COMPARATIVE EXAMPLE | 12 | 1200 | 60 | 50 | | 0.0016 |
| COMPARATIVE EXAMPLE | 13 | 1300 | 35 | 43 | 45 | 0.0016 |
| COMPARATIVE EXAMPLE | 14 | 1300 | 35 | 43 | 45 | 0.0016 |
| EXAMPLE | 15 | 1330 | 6 | 37 | 30 | 0.0015 |
| EXAMPLE | 16 | 1330 | 6 | 37 | 30 | 0.0014 |
| EXAMPLE | 17 | 1330 | 9 | 30 | 47 | 0.0016 |
| COMPARATIVE EXAMPLE | 18 | 1330 | 8 | 30 | 47 | 0.0010 |
| COMPARATIVE EXAMPLE | 19 | 1340 | 14 | 28 | 56 | 0.0014 |
| COMPARATIVE EXAMPLE | 20 | 1340 | 14 | 28 | 56 | 0.0012 |
| COMPARATIVE EXAMPLE | 21 | 1300 | 13 | 35 | 30 | 0.0014 |
| COMPARATIVE EXAMPLE | 22 | 1300 | 13 | 35 | 30 | 0.0015 |
| EXAMPLE | 23 | 1320 | 12 | 20 | 50 | 0.0014 |
| COMPARATIVE EXAMPLE | 24 | 1320 | 12 | 20 | 50 | 0.0015 |
| COMPARATIVE EXAMPLE | 25 | 1330 | 6 | 37 | 30 | 0.0015 |
| EXAMPLE | 26 | 1330 | 6 | 37 | 30 | 0.0014 |
| EXAMPLE | 27 | 1330 | 7 | 24 | 28 | 0.0016 |
| EXAMPLE | 28 | 1320 | 9 | 27 | | 0.0006 |
| EXAMPLE | 29 | 1330 | 9 | 27 | 40 | 0.0036 |

| | No. | ΔN (MASS %) | TOTAL CONTENT OF N (MASS %) | VALUE B (%) | AVERAGE GRAIN DIAMETER OF PRIMARY RECRYSTALLIZATION GRAINS (μm) | MAGNETIC PROPERTIES (W17/50, $B_8$) |
|---|---|---|---|---|---|---|
| COMPARATIVE EXAMPLE | 11 | 0.0115 | 0.0163 | 15 | 24.0 | SKID MARK WAS GENERATED |
| COMPARATIVE EXAMPLE | 12 | 0.0150 | 0.0198 | 15 | 24.0 | SKID MARK WAS GENERATED |
| COMPARATIVE EXAMPLE | 13 | 0.0050 | 0.0132 | 10 | 12.0 | SKID MARK WAS GENERATED |
| COMPARATIVE EXAMPLE | 14 | 0.0050 | 0.0132 | 17 | 12.0 | SKID MARK WAS GENERATED |
| EXAMPLE | 15 | 0.0130 | 0.0177 | 15 | 11.7 | 0.97 W/kg, 1.96 T |
| EXAMPLE | 16 | 0.0101 | 0.0148 | 13 | 11.7 | 0.96 W/kg, 1.96 T |
| EXAMPLE | 17 | 0.0120 | 0.0161 | 15 | 12.0 | 0.98 W/kg, 1.94 T |
| COMPARATIVE EXAMPLE | 18 | 0 | 0.0041 | 10 | 12.0 | SECONDARY RECRYSTALLIZATION WAS POOR |
| COMPARATIVE EXAMPLE | 19 | 0.0150 | 0.0192 | 18 | 11.8 | 1.08 W/kg, 1.85 T |
| COMPARATIVE EXAMPLE | 20 | 0.0100 | 0.0142 | 5 | 11.8 | 1.06 W/kg, 1.87 T |
| COMPARATIVE EXAMPLE | 21 | 0.0098 | 0.0144 | 45 | 11.2 | 1.00 W/kg, 1.90 T |
| COMPARATIVE EXAMPLE | 22 | 0.0115 | 0.0161 | 40 | 11.2 | 0.99 W/kg, 1.91 T |
| EXAMPLE | 23 | 0.0110 | 0.0160 | 25 | 13.5 | 0.97 W/kg, 1.94 T |
| COMPARATIVE EXAMPLE | 24 | 0.0140 | 0.0190 | 40 | 13.5 | 1.02 W/kg, 1.91 T |
| COMPARATIVE EXAMPLE | 25 | 0.0130 | 0.0177 | 45 | 12.1 | 0.97 W/kg, 1.90 T |
| EXAMPLE | 26 | 0.0101 | 0.0148 | 22 | 12.1 | 0.96 W/kg, 1.94 T |
| EXAMPLE | 27 | 0.0120 | 0.0161 | 30 | 11.9 | 0.98 W/kg, 1.93 T |
| EXAMPLE | 28 | 0.0110 | 0.0133 | 25 | 13.5 | 0.97 W/kg, 1.94 T |
| EXAMPLE | 29 | 0.0101 | 0.0119 | 22 | 12.7 | 0.96 W/kg, 1.95 T |

As shown in Table 4, in examples Nos. 15, 16, 17, 23, 26, 27, 28 and 29, high magnetic properties, especially, high magnetic flux density ($B_8$) were obtained. In particular, higher magnetic properties were obtained in the examples Nos. 15 to 17, in which ammonia was introduced from the directions above and below the strips.

Experimental Example 3

Slabs each composed of components shown in Table 5 were melted and the slabs were heated at 1230° C. to 1350° C. (step S1).

Thereafter, nitriding treatment was performed on the steel strips, while running the strips (steel strips), in an ammonia atmosphere in which ammonia was introduced from directions above and below the strips (step S6). At this time, an introduction amount of ammonia introduced into the atmosphere was changed in various ways to change an amount of nitriding.

Subsequently, an annealing separating agent having MgO as its main component was coated on both surfaces of the steel strips after the nitriding treatment, and finish annealing was conducted to cause secondary recrystallization (step S7). Specifically, secondary recrystallization annealing was performed. The finish annealing was conducted in an atmosphere in which a ratio of $N_2$ was 25 vol % and a ratio of $H_2$ was 75 vol %, and a temperature of the steel strips was raised up to 1200° C. at 10° C./hour to 20° C./hour. Next, purification treatment was performed at a temperature of 1200° C. for 20 hours or more, in an atmosphere in which a ratio of $H_2$ was 100 vol %. Further, a coating of an insulation tension coating, and a flattening treatment were performed.

In such a series of treatment processes, various precipitation rates and increasing amounts of nitriding and magnetic properties in the obtained grain-oriented electrical steel sheets were measured. Results thereof are shown in Table 6.

TABLE 5

| | No. | C | Si | Mn | ACID-SOLUBLE Al | N | S | Se | Ti | Sn | Sb | Cu | VALUE A |
|---|---|---|---|---|---|---|---|---|---|---|---|---|---|
| COMPARATIVE EXAMPLE | 31 | 0.068 | 3.25 | 0.046 | 0.0265 | 0.0048 | 0.017 | | 0.0010 | 0.12 | | 0.10 | 1.58 |
| EXAMPLE | 32 | 0.068 | 3.25 | 0.046 | 0.0265 | 0.0048 | 0.017 | | 0.0010 | 0.12 | | 0.10 | 1.58 |
| EXAMPLE | 33 | 0.075 | 3.40 | 0.051 | 0.0269 | 0.0041 | 0.019 | | 0.0018 | 0.11 | | 0.07 | 1.57 |
| EXAMPLE | 34 | 0.075 | 3.40 | 0.051 | 0.0269 | 0.0041 | 0.019 | | 0.0018 | 0.11 | | 0.07 | 1.57 |
| COMPARATIVE EXAMPLE | 35 | 0.071 | 3.28 | 0.049 | 0.0250 | 0.0045 | 0.010 | | 0.0078 | 0.13 | | 0.13 | 2.87 |
| COMPARATIVE EXAMPLE | 36 | 0.071 | 3.28 | 0.049 | 0.0250 | 0.0045 | 0.010 | | 0.0078 | 0.13 | | 0.13 | 2.87 |
| EXAMPLE | 37 | 0.068 | 3.35 | 0.043 | 0.0275 | 0.0051 | 0.006 | 0.018 | 0.0022 | 0.11 | | 0.09 | 1.89 |
| EXAMPLE | 38 | 0.068 | 3.35 | 0.043 | 0.0275 | 0.0051 | 0.006 | 0.018 | 0.0022 | 0.11 | | 0.09 | 1.89 |
| EXAMPLE | 39 | 0.075 | 3.40 | 0.051 | 0.0269 | 0.0041 | 0.019 | | 0.0018 | | | | 1.57 |
| EXAMPLE | 40 | 0.075 | 3.40 | 0.051 | 0.0269 | 0.0041 | 0.019 | | 0.0018 | | | 0.07 | 1.57 |

UNIT OF CONTENT OF EACH ELEMENT: MASS %

Next, hot rolling was conducted (step S2), thereby obtaining hot-rolled steel strips each having a thickness of 2.3 mm. Regarding the hot rolling, in order to suppress the precipitation of substances functioning as inhibitors (AlN, MnS, Cu—S and MnSe) as much as possible, finish hot rolling was started at a temperature exceeding 1050° C., and after the finish hot rolling, quick cooling was performed. Thereafter, continuous annealing was performed on the hot-rolled steel strips at 1120° C. for 30 seconds, further performed at 930° C. for 60 seconds, and the steel strips were cooled at 20° C./second (step S3). Subsequently, the steel strips were subjected to cold rolling at 200° C. to 250° C., thereby obtaining cold-rolled steel strips each having a thickness of 0.22 mm (step S4). Next, the steel strips were heated up to 800° C. at 200° C./second, heated from 800° C. up to 850° C. at about 20° C./second, and annealed, for decarburization and primary recrystallization, at 850° C. for 110 seconds in a mixed atmosphere of $H_2$ and $N_2$ at a dew point of 65° C. (step S5).

TABLE 6

| | No. | TEMPERATURE FOR HEATING SLAB (° C.) | PRECIPITATION RATE OF N (%) (N as AlN) | PRECIPITATION RATE OF S AND Se AS COMPOUNDS WITH Mn (%) | PRECIPITATION RATE OF S AND Se AS COMPOUNDS WITH Cu (%) | VALUE I |
|---|---|---|---|---|---|---|
| COMPARATIVE EXAMPLE | 31 | 1230 | 45 | 55 | 40 | 0.0011 |
| EXAMPLE | 32 | 1330 | 9 | 40 | 40 | 0.0015 |
| EXAMPLE | 33 | 1300 | 9 | 37 | 52 | 0.0013 |
| EXAMPLE | 34 | 1300 | 9 | 37 | 52 | 0.0015 |
| COMPARATIVE EXAMPLE | 35 | 1350 | 10 | 25 | 35 | 0.0009 |
| COMPARATIVE EXAMPLE | 36 | 1350 | 10 | 25 | 35 | 0.0013 |
| EXAMPLE | 37 | 1320 | 12 | 30 | 40 | 0.0012 |
| EXAMPLE | 38 | 1320 | 12 | 30 | 40 | 0.0014 |
| EXAMPLE | 39 | 1300 | 9 | 38 | | 0.0013 |
| EXAMPLE | 40 | 1300 | 9 | 38 | 48 | 0.0015 |

| | No. | ΔN (MASS %) | TOTAL CONTENT OF N (MASS %) | AVERAGE GRAIN DIAMETER OF PRIMARY RECRYSTALLIZATION GRAINS (μm) | MAGNETIC PROPERTIES (W17/50, $B_8$) |
|---|---|---|---|---|---|
| COMPARATIVE EXAMPLE | 31 | 0.0034 | 0.0082 | 22.0 | SKID MARK WAS GENERATED |
| EXAMPLE | 32 | 0.0112 | 0.016 | 12.5 | 0.80 W/kg, 1.94 T |
| EXAMPLE | 33 | 0.0065 | 0.0106 | 13.4 | 0.77 W/kg, 1.95 T |
| EXAMPLE | 34 | 0.0110 | 0.0151 | 13.4 | 0.80 W/kg, 1.96 T |
| COMPARATIVE EXAMPLE | 35 | 0.0067 | 0.0112 | 11.3 | SECONDARY RECRYSTALLIZATION WAS POOR |
| COMPARATIVE EXAMPLE | 36 | 0.0138 | 0.0183 | 11.3 | SECONDARY RECRYSTALLIZATION WAS POOR |
| EXAMPLE | 37 | 0.0092 | 0.0143 | 10.5 | 0.78 W/kg, 1.95 T |
| EXAMPLE | 38 | 0.0120 | 0.0171 | 10.5 | 0.82 W/kg, 1.92 T |
| EXAMPLE | 39 | 0.0065 | 0.0106 | 11.6 | 0.77 W/kg, 1.95 T |
| EXAMPLE | 40 | 0.0110 | 0.0151 | 9.5 | 0.80 W/kg, 1.96 T |

As shown in Table 6, in examples Nos. 32, 33, 34, 37, 38, 39 and 40, high magnetic properties, especially, high magnetic flux density ($B_8$) were obtained.

Experimental Example 4

Slabs each composed of components shown in Table 7 were melted and the slabs were heated at 1200° C. to 1340° C. (step S1).

TABLE 7

| | No. | C | Si | Mn | ACID-SOLUBLE Al | N | S | Se | Ti | Sn | Sb | Cu | VALUE A |
|---|---|---|---|---|---|---|---|---|---|---|---|---|---|
| COMPARATIVE EXAMPLE | 41 | 0.065 | 3.30 | 0.055 | 0.0252 | 0.0040 | 0.016 | | 0.0035 | | | | 2.01 |
| COMPARATIVE EXAMPLE | 42 | 0.065 | 3.30 | 0.055 | 0.0252 | 0.0040 | 0.016 | | 0.0035 | | | | 2.01 |
| COMPARATIVE EXAMPLE | 43 | 0.078 | 3.38 | 0.080 | 0.0249 | 0.0083 | 0.024 | | 0.0028 | 0.10 | | 0.07 | 1.95 |
| COMPARATIVE EXAMPLE | 44 | 0.078 | 3.38 | 0.080 | 0.0249 | 0.0083 | 0.024 | | 0.0028 | 0.10 | | 0.07 | 1.95 |
| EXAMPLE | 45 | 0.077 | 3.25 | 0.058 | 0.0258 | 0.0046 | 0.017 | | 0.0020 | 0.13 | | 0.08 | 1.99 |
| EXAMPLE | 46 | 0.077 | 3.25 | 0.058 | 0.0258 | 0.0046 | 0.017 | | 0.0020 | 0.13 | | 0.08 | 1.99 |
| EXAMPLE | 47 | 0.068 | 3.45 | 0.062 | 0.0277 | 0.0040 | 0.021 | | 0.0035 | | 0.05 | 0.09 | 1.73 |
| COMPARATIVE EXAMPLE | 48 | 0.068 | 3.45 | 0.062 | 0.0277 | 0.0040 | 0.022 | | 0.0035 | | 0.05 | 0.09 | 1.65 |
| COMPARATIVE EXAMPLE | 49 | 0.079 | 3.41 | 0.053 | 0.0281 | 0.0047 | 0.012 | | 0.0009 | 0.08 | | 0.12 | 2.58 |
| COMPARATIVE EXAMPLE | 50 | 0.079 | 3.41 | 0.053 | 0.0281 | 0.0047 | 0.012 | | 0.0009 | 0.08 | | 0.12 | 2.58 |
| COMPARATIVE EXAMPLE | 51 | 0.068 | 3.25 | 0.046 | 0.0265 | 0.0048 | 0.017 | | 0.0010 | 0.12 | | 0.10 | 1.58 |

TABLE 7-continued

| | No. | C | Si | Mn | ACID-SOLUBLE Al | N | S | Se | Ti | Sn | Sb | Cu | VALUE A |
|---|---|---|---|---|---|---|---|---|---|---|---|---|---|
| EXAMPLE | 52 | 0.075 | 3.40 | 0.051 | 0.0269 | 0.0041 | 0.019 | | 0.0018 | 0.11 | | 0.07 | 1.57 |
| EXAMPLE | 53 | 0.075 | 3.40 | 0.051 | 0.0269 | 0.0041 | 0.019 | | 0.0018 | 0.11 | | 0.07 | 1.57 |
| COMPARATIVE EXAMPLE | 54 | 0.068 | 3.35 | 0.043 | 0.0275 | 0.0051 | 0.006 | 0.018 | 0.0022 | 0.11 | | 0.09 | 1.89 |
| EXAMPLE | 55 | 0.068 | 3.35 | 0.043 | 0.0275 | 0.0051 | 0.006 | 0.018 | 0.0022 | 0.11 | | 0.09 | 1.89 |
| EXAMPLE | 56 | 0.077 | 3.25 | 0.058 | 0.0258 | 0.0046 | 0.017 | | 0.0020 | 0.13 | | 0.08 | 1.99 |
| COMPARATIVE EXAMPLE | 57 | 0.077 | 3.25 | 0.058 | 0.0258 | 0.0046 | 0.017 | | 0.0020 | 0.13 | | 0.08 | 1.99 |
| EXAMPLE | 58 | 0.068 | 3.45 | 0.062 | 0.0277 | 0.0040 | 0.021 | | 0.0035 | | 0.05 | 0.09 | 1.73 |
| EXAMPLE | 59 | 0.075 | 3.40 | 0.051 | 0.0269 | 0.0041 | 0.019 | | 0.0018 | | | | 1.57 |
| EXAMPLE | 60 | 0.077 | 3.25 | 0.058 | 0.0258 | 0.0046 | 0.017 | | 0.0020 | | | 0.08 | 1.99 |

UNIT OF CONTENT OF EACH ELEMENT: MASS %

Next, cold-rolled steel strips were obtained in the same manner as the experimental example 3 (steps S2 to S4). After that, the steel strips were heated up to 800° C. at 200° C./second, heated from 800° C. up to 850° C. at about 20° C./second, and annealed, for decarburization and primary recrystallization, at 850° C. for 110 seconds in a mixed atmosphere of $H_2$ and $N_2$ at a dew point of 65° C. (step S5). Subsequently, the steel strips were subjected to nitriding treatment (step S6). At this time, an introduction amount of ammonia introduced into an atmosphere was changed in various ways to change an amount of nitriding. Further, regarding the steel strips in Nos. 41 to 50, the nitriding treatment was performed on the steel strips, while running the strips (steel strips), in an ammonia atmosphere in which ammonia was introduced from directions above and below the strips, in the same manner as the experimental example 1. Further, regarding the steel strips in Nos. 51 to 60, the nitriding treatment was performed on the steel strips, while running the strips (steel strips), in an ammonia atmosphere in which ammonia was introduced only from a direction above the strips.

Subsequently, an annealing separating agent having MgO as its main component was coated on both surfaces of the steel strips after the nitriding treatment, and finish annealing was conducted to cause secondary recrystallization (step S7). Specifically, secondary recrystallization annealing was performed. The finish annealing was conducted in an atmosphere in which a ratio of $N_2$ was 25 vol % and a ratio of $H_2$ was 75 vol %, and a temperature of the steel strips was raised up to 1200° C. at 10 to 20° C./hour.

In such a series of treatment processes, various precipitation rates and increasing amounts of nitriding and magnetic properties in the obtained grain-oriented electrical steel sheets were measured. Results thereof are shown in Table 8.

TABLE 8

| | No. | TEMPERATURE FOR HEATING SLAB (° C.) | PRECIPITATION RATE OF N (%) (N as AlN) | PRECIPITATION RATE OF S AND Se AS COMPOUNDS WITH Mn (%) | PRECIPITATION RATE OF S AND Se AS COMPOUNDS WITH Cu (%) | VALUE I |
|---|---|---|---|---|---|---|
| COMPARATIVE EXAMPLE | 41 | 1200 | 41 | 60 | | 0.0014 |
| COMPARATIVE EXAMPLE | 42 | 1200 | 41 | 60 | | 0.0017 |
| COMPARATIVE EXAMPLE | 43 | 1300 | 35 | 58 | 68 | 0.0017 |
| COMPARATIVE EXAMPLE | 44 | 1300 | 35 | 58 | 68 | 0.0019 |
| EXAMPLE | 45 | 1330 | 6 | 31 | 55 | 0.0016 |
| EXAMPLE | 46 | 1330 | 6 | 31 | 55 | 0.0015 |
| EXAMPLE | 47 | 1330 | 11 | 38 | 50 | 0.0017 |
| COMPARATIVE EXAMPLE | 48 | 1330 | 11 | 38 | 50 | 0.0011 |
| COMPARATIVE EXAMPLE | 49 | 1340 | 10 | 35 | 45 | 0.0014 |
| COMPARATIVE EXAMPLE | 50 | 1340 | 10 | 35 | 45 | 0.0013 |
| COMPARATIVE EXAMPLE | 51 | 1330 | 9 | 55 | 40 | 0.0015 |
| EXAMPLE | 52 | 1300 | 9 | 37 | 52 | 0.0013 |
| EXAMPLE | 53 | 1300 | 9 | 37 | 52 | 0.0015 |
| COMPARATIVE EXAMPLE | 54 | 1320 | 15 | 35 | 30 | 0.0012 |
| EXAMPLE | 55 | 1320 | 15 | 35 | 30 | 0.0014 |
| EXAMPLE | 56 | 1330 | 6 | 28 | 40 | 0.0016 |
| COMPARATIVE EXAMPLE | 57 | 1330 | 6 | 28 | 40 | 0.0015 |

TABLE 8-continued

| | | | | | | |
|---|---|---|---|---|---|---|
| EXAMPLE | 58 | 1330 | 11 | 30 | 51 | 0.0017 |
| EXAMPLE | 59 | 1300 | 9 | 30 | | 0.0015 |
| EXAMPLE | 60 | 1330 | 6 | 30 | 48 | 0.0016 |

| | No. | ΔN (MASS %) | TOTAL CONTENT OF N (MASS %) | VALUE B (%) | AVERAGE GRAIN DIAMETER OF PRIMARY RECRYSTALLIZATION GRAINS (μm) | MAGNETIC PROPERTIES (W17/50, $B_8$) |
|---|---|---|---|---|---|---|
| COMPARATIVE EXAMPLE | 41 | 0.0120 | 0.0160 | 10 | 24.5 | SKID MARK WAS GENERATED |
| COMPARATIVE EXAMPLE | 42 | 0.0180 | 0.0220 | 11 | 24.5 | SKID MARK WAS GENERATED |
| COMPARATIVE EXAMPLE | 43 | 0.0065 | 0.0148 | 5 | 11.0 | SKID MARK WAS GENERATED |
| COMPARATIVE EXAMPLE | 44 | 0.0120 | 0.0203 | 10 | 11.0 | SKID MARK WAS GENERATED |
| EXAMPLE | 45 | 0.0135 | 0.0181 | 13 | 12.8 | 0.83 W/kg, 1.95 T |
| EXAMPLE | 46 | 0.0110 | 0.0156 | 15 | 12.8 | 0.78 W/kg, 1.95 T |
| EXAMPLE | 47 | 0.0124 | 0.0164 | 12 | 11.0 | 0.80 W/kg, 1.96 T |
| COMPARATIVE EXAMPLE | 48 | 0 | 0.0040 | 9 | 11.7 | SECONDARY RECRYSTALLIZATION WAS POOR |
| COMPARATIVE EXAMPLE | 49 | 0.0145 | 0.0192 | 8 | 13.5 | 0.90 W/kg, 1.85 T |
| COMPARATIVE EXAMPLE | 50 | 0.0112 | 0.0159 | 5 | 13.5 | 0.89 W/kg, 1.87 T |
| COMPARATIVE EXAMPLE | 51 | 0.0112 | 0.0160 | 37 | 13.5 | SECONDARY RECRYSTALLIZATION WAS POOR |
| EXAMPLE | 52 | 0.0065 | 0.0106 | 31 | 14.5 | 0.77 W/kg, 1.95 T |
| EXAMPLE | 53 | 0.0110 | 0.0151 | 30 | 14.5 | 0.80 W/kg, 1.93 T |
| COMPARATIVE EXAMPLE | 54 | 0.0092 | 0.0143 | 40 | 11.2 | 1.10 W/kg, 1.86 T |
| EXAMPLE | 55 | 0.0120 | 0.0171 | 25 | 11.2 | 0.80 W/kg, 1.94 T |
| EXAMPLE | 56 | 0.0135 | 0.0181 | 24 | 10.8 | 0.83 W/kg, 1.94 T |
| COMPARATIVE EXAMPLE | 57 | 0.0110 | 0.0156 | 40 | 10.8 | SECONDARY RECRYSTALLIZATION WAS POOR |
| EXAMPLE | 58 | 0.0124 | 0.0164 | 28 | 9.7 | 0.80 W/kg, 1.93 T |
| EXAMPLE | 59 | 0.0110 | 0.0151 | 30 | 11.6 | 0.80 W/kg, 1.94 T |
| EXAMPLE | 60 | 0.0135 | 0.0181 | 24 | 9.4 | 0.82 W/kg, 1.95 T |

As shown in Table 8, in examples Nos. 45, 46, 47, 52, 53, 55, 56, 58, 59 and 60, high magnetic properties, especially, high magnetic flux density ($B_8$) were obtained. In particular, higher magnetic properties were obtained in the examples Nos. 45 to 47, in which ammonia was introduced from the directions above and below the strips.

Experimental Example 5

Figure 6:
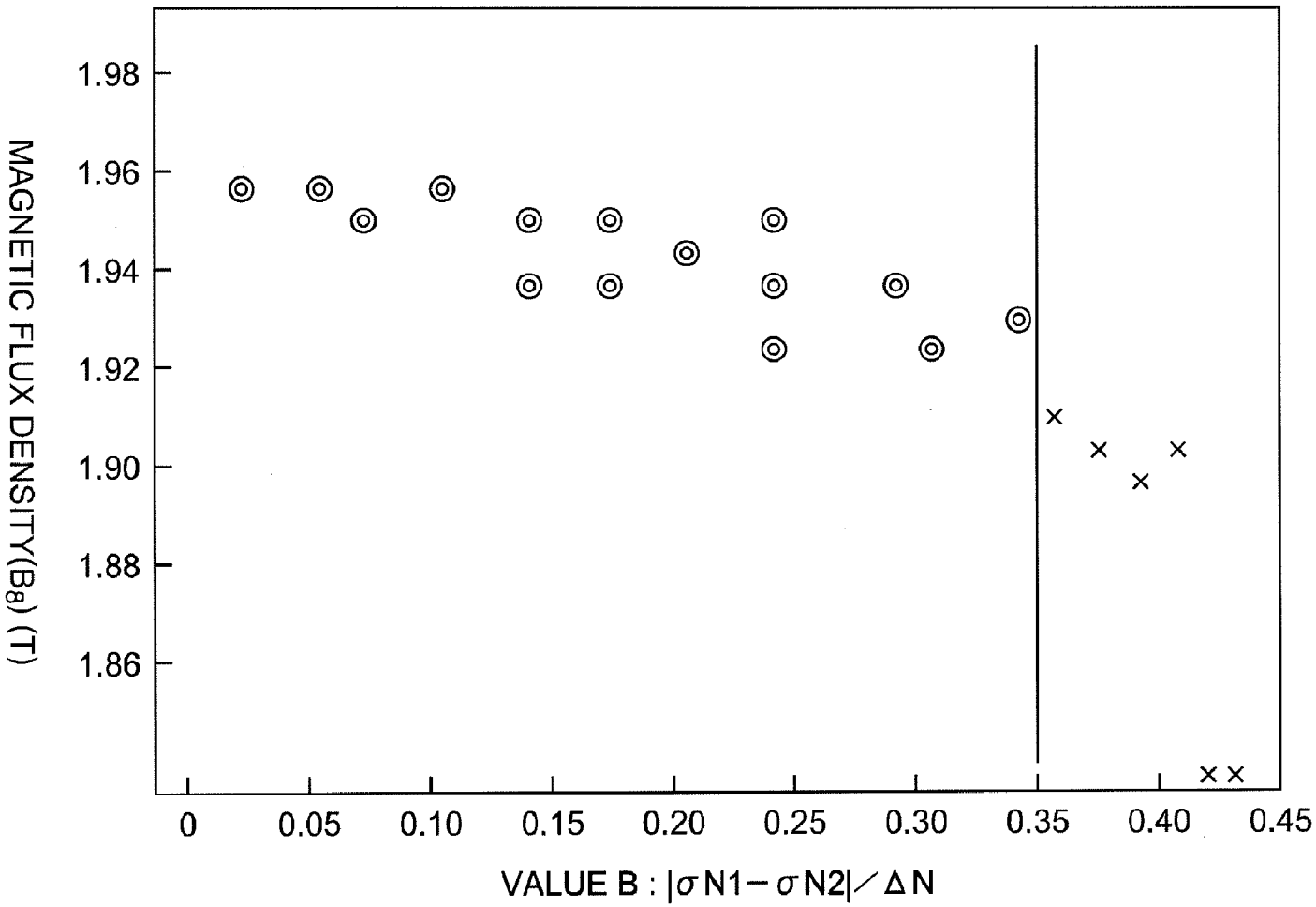
FIG. 6 is a graph showing results of an experimental example 5.

The increasing amount of N content in the nitriding treatment (step S6) performed on the steel strips obtained from the slabs in the examples No. 3, No. 4 of the experimental example 1 was set to 0.010 mass % to 0.013 mass %. Further, in the nitriding treatment, the introduction amount of ammonia introduced above and below the running strips (steel strips) was adjusted and the value B was changed in various ways. After that, grain-oriented electrical steel sheets were manufactured in the same manner as the experimental example 1. Further, a relation between the value B and the magnetic flux density ($B_8$) was examined. Results thereof are shown in FIG. 6. In FIG. 6, ◎ indicates that good magnetic flux density ($B_8$) was obtained, and X indicates that sufficient magnetic flux density ($B_8$) was not obtained.

As shown in FIG. 6, when the value B was 0.35 or less, a steel sheet with high magnetic flux density was obtained in a stable manner. Meanwhile, when the value B exceeds 0.35, the magnetic flux density was low. In particular, in a sample whose magnetic flux density was less than 1.86 T, the secondary recrystallization was unstable.

Experimental Example 6

Figure 7:
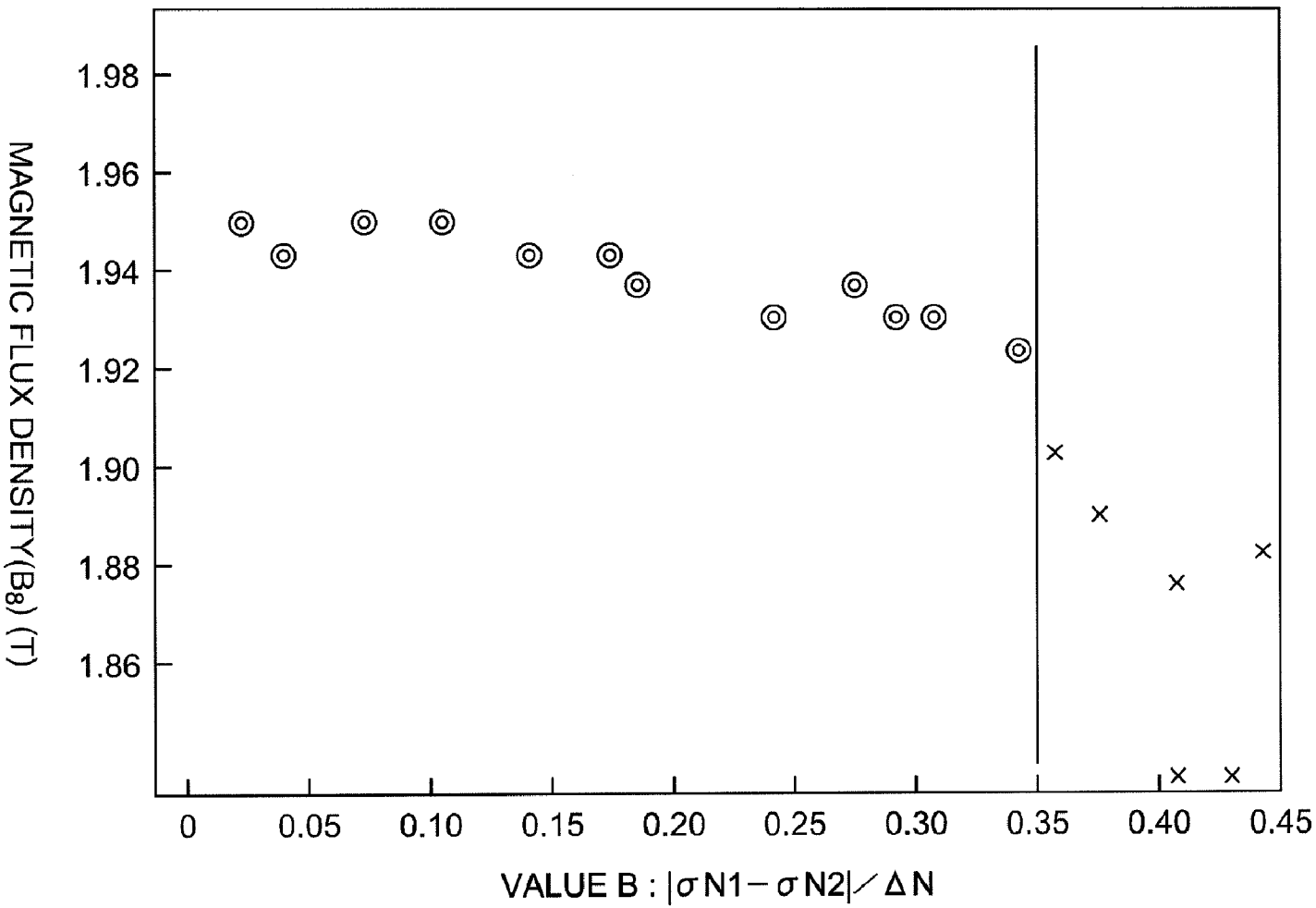
FIG. 7 is a graph showing results of an experimental example 6.

The increasing amount of N content in the nitriding treatment (step S6) performed on the steel strips obtained from the slabs in the examples No. 33, No. 34 of the experimental example 3 was set to 0.009 mass % to 0.012 mass %. Further, in the nitriding treatment, the introduction amount of ammonia introduced above and below the running strips (steel strips) was adjusted and the value B was changed in various ways. After that, grain-oriented electrical steel sheets were manufactured in the same manner as the experimental example 3. Further, a relation between the value B and the magnetic flux density ($B_8$) was examined. Results thereof are shown in FIG. 7. In FIG. 7, ◎ indicates that good magnetic flux density ($B_8$) was obtained, and X indicates that sufficient magnetic flux density ($B_8$) was not obtained.

As shown in FIG. 7, when the value B was 0.35 or less, a steel sheet with high magnetic flux density was obtained in a stable manner. Meanwhile, when the value B exceeds 0.35, the magnetic flux density was low. In particular, in a sample whose magnetic density was less than 1.86 T, the secondary recrystallization was unstable.

Industrial Applicability

The present invention can be utilized in an industry of manufacturing grain oriented electrical steel sheets and an industry in which grain oriented electrical steel sheets are used.

The invention claimed is:

1. A manufacturing method of a grain-oriented electrical steel sheet, comprising:

heating a slab containing:

C: 0.04 mass % to 0.09 mass %;

Si: 2.5 mass % to 4.0 mass %;

acid-soluble Al: 0.022 mass % to 0.031 mass %;

N: 0.003 mass % to 0.006 mass %;

S and Se: 0.013 mass % to 0.022 mass % when converted into an S equivalent Seq represented by "[S]+0.405×[Se]" in which an S content is set as [S] and a Se content is set as [Se]; and Mn: 0.045 mass % to 0.065 mass %, a Ti content being 0.005 mass % or less, and a balance being composed of Fe and inevitable impurities, at 1280° C. to 1390° C., to make a substance functioning as an inhibitor to be solid-solved;

next, hot-rolling the slab to obtain a steel strip;

annealing the steel strip to form a primary inhibitor in the steel strip;

next, cold-rolling the steel strip once or more;

next, annealing the steel strip to perform decarburization and to cause primary recrystallization;

next, performing nitriding treatment on the steel strip in a mixed gas of hydrogen, nitrogen and ammonia to form a secondary inhibitor in the steel strip; and next, annealing the steel strip to cause secondary recrystallization, wherein in said hot rolling, a ratio of N, contained in the slab, that is precipitated as AlN in the steel strip is set to 35% or less, and a ratio of S and Se, contained in the slab, that are precipitated as MnS or MnSe in the steel strip is set to 45% or less when converted into the S equivalent, said annealing to form the primary inhibitor in the steel strip is performed before a last-performed one of said cold rolling that is performed once or more, a rolling rate in the last-performed one of said cold rolling that is performed once or more is set to 84% to 92%, a circle-equivalent average grain diameter (diameter) of crystal grains obtained through the primary recrystallization is set to not less than 8 μm nor more than 15 μm, when a Mn content (mass %) in the slab is set as [Mn], a value A represented by an equation (1) satisfies an equation (2),

[Mathematical Expression 1]

$$A=([Mn]/54.9)/(Seq/32.1) \quad \text{equation (1)}$$

$$1.6 \leqq A \leqq 2.3 \quad \text{equation (2), and}$$

when a N content (mass %) in the slab is set as [N], and an amount of N (mass %) in the steel strip that is increased by said nitriding treatment is set as ΔN, a value I represented by an equation (3) satisfies an equation (4)

[Mathematical Expression 2]

$$I=1.3636\times[Seq]/32.1+0.5337\times[N]/14.0+0.7131\times\Delta N/14.0 \quad \text{equation (3)}$$

$$0.0011 \leqq I \leqq 0.0017 \quad \text{equation (4).}$$

2. The manufacturing method of the grain-oriented electrical steel sheet according to claim 1, wherein, the slab further contains Cu: 0.05 mass % to 0.30 mass %, and in a stage where the last-performed one of said cold rolling that is performed once or more is conducted, a ratio of S and Se, contained in the slab, that are precipitated as Cu—S or Cu—Se in the steel strip is set to 25% to 60% when converted into the S equivalent.

3. The manufacturing method of the grain-oriented electrical steel sheet according to claim 1, wherein the slab further contains at least one kind selected from a group consisting of Sn and Sb in a total amount of 0.02 mass % to 0.30 mass %.

4. The manufacturing method of the grain-oriented electrical steel sheet according to claim 1, wherein, in said nitriding treatment, when a N content of a 20% thickness portion of one surface of the steel strip is set as σN1 (mass %), a N content of a 20% thickness portion of the other surface of the steel strip is set as σN2 (mass %), and an amount of N (mass %) in the steel strip that is increased by said nitriding treatment is set as ΔN, a value B represented by an equation (5) satisfies an equation (6):

[Mathematical Expression 3]

$$B=|\sigma N1-\sigma N2|/\Delta N \quad \text{equation (5)}$$

$$B \leqq 0.35 \quad \text{equation (6).}$$

5. The manufacturing method of the grain-oriented electrical steel sheet according to claim 4, wherein said nitriding treatment is performed in a nitriding furnace, the nitriding furnace comprises:

one pipe or more provided only at one side of a bottom and a top surface of the steel strip based on a space in which the steel strip runs and through which ammonia gas passes; and nozzles provided to the pipe, and when a shortest distance between a tip of the nozzle and the steel strip is set as t1, a distance between the steel strip and a wall portion positioned on the opposite side of the pipe of the nitriding furnace is set as t2, distances between both edge portions in a width direction of the steel strip and wall portions positioned on the sides of the steel strip of the nitriding furnace are set as t3, a width of the steel strip is set as W, a maximum width between the nozzles located at both ends among the nozzles is set as L, and a center-to-center distance between adjacent nozzles among the nozzles is set as 1, relations of equation (7) to equation (11) are satisfied.

[Mathematical Expression 4]

$$t1 \leqq 50 \text{ mm} \quad \text{equation (7)}$$

$$1 \leqq t1 \quad \text{equation (8)}$$

$$t2 \leqq 2\times t1 \quad \text{equation (9)}$$

$$t3 \leqq 2.5\times t1 \quad \text{equation (10)}$$

$$L \leqq 1.2\times W \quad \text{equation (11).}$$

6. The manufacturing method of the grain-oriented electrical steel sheet according to claim 5, wherein the pipe is composed of three pipe units, and a distance between each of the three pipe units in a running direction of the steel strip is 550 mm or less.

7. The manufacturing method of the grain-oriented electrical steel sheet according to claim 4, wherein said nitriding treatment is performed in a nitriding furnace, the nitriding furnace comprises one inlet or more provided to both wall portions positioned on the sides of the steel strip based on a space in which the steel strip runs and into which ammonia gas is supplied, and when distances between both edge portions in a width direction of the steel strip and wall portions positioned on the sides of the steel strip of the nitriding furnace are set as t3, distances between the steel strip and wall portions parallel to a bottom and a top surface of the steel strip of the nitriding furnace are set as t4, a width of the steel strip is set as W, and a distance between the space in which the steel strip runs and the inlet is set as H, relations of equation (12) to equation (14) are satisfied:

[Mathematical Expression 5]

$$t3 \leqq W/3 \quad \text{equation (12)}$$

$$t4 \leqq 100\ \text{mm} \quad \text{equation (13)}$$

$$H \leqq W/3 \quad \text{equation (14).}$$

8. The manufacturing method of the grain-oriented electrical steel sheet according to claim 1, wherein the steel strip is maintained in a temperature range of 100° C. to 300° C. for one minute or more during at least one pass of the last-performed one of said cold rolling that is performed once or more.

9. The manufacturing method of the grain-oriented electrical steel sheet according to claim 1, wherein, in said annealing to perform the decarburization and to cause the primary recrystallization, a heating rate from a start of temperature rise up to 650° C. or higher is set to 100° C./second or more.

* * * * *